US005640917A

United States Patent [19]

Nii et al.

[11] Patent Number: 5,640,917

[45] Date of Patent: Jun. 24, 1997

[54] WELT FORMING DEVICE, AND FABRIC GUIDE

[75] Inventors: Tomio Nii; Yutaka Hirasawa, both of Tokyo, Japan

[73] Assignee: Juki Corporation, Tokyo, Japan

[21] Appl. No.: 413,152

[22] Filed: Mar. 29, 1995

[30] Foreign Application Priority Data

Mar. 30, 1994 [JP] Japan ..... 6-061392
May 23, 1994 [JP] Japan ..... 6-108680

[51] Int. Cl.[6] ..... D05B 21/00; D05B 3/12; D05B 25/00

[52] U.S. Cl. ..... 112/470.12; 112/475.06; 112/475.09; 112/470.16; 112/147; 112/104; 112/155; 112/163

[58] Field of Search ..... 112/147, 148, 112/475.06, 475.09, 104, 141, 65, 68, 70, 155, 163, 470.12, 470.16

[56] References Cited

U.S. PATENT DOCUMENTS 3,115,854 12/1963 Coletta .
4,481,895 11/1984 Asao et al. ..... 112/68 X
4,573,420 3/1986 Carson ..... 112/147 X
5,165,353 11/1992 Freemann ..... 112/147
5,333,563 8/1994 Yamanoi .

FOREIGN PATENT DOCUMENTS 5-208084 8/1993 Japan .

*Primary Examiner*—Paul C. Lewis
*Attorney, Agent, or Firm*—Morgan, Lewis and Bockius LLP

[57] ABSTRACT

A welt forming device comprises: base fabric holding means which is able to hold a base fabric flat at all times; and welt fabric holding means for fixedly holding a welt fabric on the base fabric. Those means are moved in a sewing direction in synchronization with the vertical movement of the sewing needle of seam forming means, to form a first seam to sew the welt fabric to the base fabric. The device further comprises: first welt fabric folding means for folding one side portion of the welt fabric along the first seam over the other side portion; second welt fabric holding means for folding the other side portion of the welt fabric over the one side portion which has been folded by the first welt fabric holding means; and auxiliary moving means for moving the relative position of the base fabric holding means and the sewing needle in a direction which is across the sewing direction.

16 Claims, 18 Drawing Sheets

WELT FORMING DEVICE, AND FABRIC GUIDE

BACKGROUND OF THE INVENTION

1. Field of the Invention

This invention relates to a welt forming device, and more particularly to a sewing machine which is so designed that a welt fabric is sewed to the base fabric.

2. Related Art

Heretofore, a welt for ornamenting, for instance, the edge of the opening of a pocket is formed according to a procedure shown in FIGS. 21(*a*) to 21(*c*).

First, a welt fabric W2 is placed on a base fabric W1, and a welt fabric ruler R T-shaped in section is set on the welt fabric W2 from above. Under this condition, both end portions of the welt fabric W2 are folded over along the ruler R thus set as shown in FIG. 21(*a*), and then the base fabric W1 and the welt fabric W2 are sewed together with sewing needles N. Thereafter, a knife is used to cut the base fabric W1 and the welt fabric W2 at the middle, as viewed in the direction of width thereof, to form an opening (or a slot) as shown in FIG. 21(*b*). The fabrics W1 and W2 thus sewed are removed from the sewing machine, and both end portions of the welt fabric W2 are passed through the opening 1*a* and then folded over the rear surface of the base fabric W1. That is, as shown in FIG. 21(*c*), the welt fabric W2 thus folded form welts which ornament the opening of the pocket.

In each of the welts thus formed, the part Wb of the pocket where the welt fabric 2 and the base fabric W1 are sewed together (hereinafter referred to as "a sewed part Wb", when applicable) is different from the part Wa of the pocket where the welt fabric W2 is exposed (hereinafter referred to as "an exposed part Wa", when applicable) in the number of layers of fabric (four layers of fabric in the sewed part Wb, and two layers of fabric in the exposed part Wb). Those two parts Wa and Wb are shifted from each other as much as T, which impairs the external appearance of the welts. In addition, it is difficult to uniformly press the welts thus formed.

In order to overcome the above-described difficulties, a method of forming welts as shown in FIG. 22(*a*) has been proposed in the art. In each of the welts, the sewed part WA where the base fabric W1 and the welt fabric W2 are sewed together is equal in the number of layers of fabric to the exposed part WB where the welt fabric W2 is exposed, and the surface of the base fabric W1 is flush with the surface of the welt fabric W2. The welts are formed by using a device as shown in FIG. 23. The conventional welt forming device is disclosed in U.S. Pat. No. 5,333,563 or PCT/JP91/00906.

The device has a pair of fabric receiving stands 1 which are moved back and forth and right and left on the upper surface of the sewing machine table. First, a base fabric W1 is placed flat on those receiving stands 1. Next, a pair of base fabric retainers 2 which are vertically movable to and from the fabric receiving stands 1, are moved downwardly onto the base fabric W1, so that the right and left end portions of the base fabric W1 are held by the right and left base fabric retainers 2 and the right and left fabric receiving stands 1.

Under this condition, the base fabric retainers 2 are slightly (about 0.5 mm) moved towards each other so that the base fabric W1 is slackened as indicated at W1a in FIG. 23. Next, a pair of welt fabric rulers 3 are set between the base fabric retainers 2 from above. Under this condition, two welt fabrics W2 are laid over the base fabric retainers 2 and the welt fabric rulers 3, respectively-one of the welt fabrics W2 is laid over one of the retainers 2 and one of the rulers 3, while the other W2 is laid over the other retainer 2 and the other ruler 3.

Under this condition, a pair of right and left retaining arm members 4, which are vertically movably provided above the base fabric retainers 2, are moved downwardly, so that the welt fabrics W2 are brought into contact with the right and left portions of the base fabric W1 near the needle drop positions P of the needles N as shown in FIG. 23.

Under this condition, a sewing-operation starting instruction is issued. In response to the instruction, the two sewing needles N held by the sewing machine arm start vertical motion while the pair of base fabric retainers 2 are moved forwardly (in a forward direction perpendicular to the surface of the drawing) in synchronization with the vertical motion of those needles N, so that the right and left portion of the base fabric W1 and the welt fabrics W2 are sewed together with seams S1 (first seams) as shown in FIG. 22(*b*) (only left portion of the base fabric W1 shown in FIG. 22(*b*)).

Thereafter, the base fabric W1 and the welt fabrics W2 together with the base fabric retainers 2 are returned to their initial positions. Under this condition, the base fabric retainers 2 are moved away from each other to stretch the base fabric W1 flat, removing the slack W1*a* therefrom.

After the retaining arm members 4 are retracted upwardly, a pair of folding members 5 which are attached to the base fabric retainers 2, respectively, are moved upwardly. Then protruding members 6 which are coupled to the welt fabric rulers 17, respectively, are protruded outwardly, so that first end portions W2*a* of the welt fabrics W2 are folded along the first seam S1 formed before, respectively, while second end portions W2*b* are folded over the first end portions W2*a*, respectively as shown in FIG. 24, and FIGS. 22(*c*) and 22(*d*).

Next, the protruding members 6 are retracted, and the retaining arm members 4 are moved downwardly to retain the welt fabrics W2. Under this condition, a second sewing operation is started. In this case, the base fabric W1 is held stretched flat (not being slackened at all). Hence, the second seams S2 formed in this sewing operation are shifted as much as a slight distance H (generally of the order of 0.5 mm) from the first seams S1, respectively as shown FIG. 22(*a*).

Thereafter, the central portion of the base fabric 1 which is located between the first and second seams is cut with a knife to form an opening (or a slot) therein. Next, the welt fabrics W2 and W2 sewed to the base fabric W1 are turned about 180° about the first seam, respectively. As a result, as shown in FIG. 22(*a*), the sewed part and the exposed part of the base fabric W1 and the welt fabrics W2 are equal in the number of layers of fabric, and the surface of the base fabric W1 and the surfaces of the welt fabrics W2 and W2 are flush with one another. That is, the welts thus formed are excellent in external appearance, and can be pressed with ease.

As was described above, with the conventional welt forming device, in forming the first seam, the base fabric W1 1 is slackened; and in forming the second seam, the base fabric W1 is stretched, so that the first seam and the second seam are slightly, as much as H, spaced from each other.

Hence, in the case where the base fabric W1 is accurately slackened, the first seam X are formed at the correct positions, and the resultant welts are satisfactory in quality. However, depending on the material or thickness of the base fabric W1, sometimes the latter W1 may not follow the base fabric retainers 2 and the fabric receiving stands 1; that is, the base fabric 1 may not accurately slackened. In this case, it is impossible to form the first seam at the correct positions.

For instance in the case where the base fabric W1 is thick, or stiff, the base fabric W1 cannot follow the movement of the fabric receiving stands 1; that is, it is not sufficiently slackened. As a result, the first seam are shifted from the aimed positions, and therefore the resultant welts are unsatisfactory in quality. In forming the welts, the positions of the first seam are important for determining the width of the welts and the positions of the end portions of the latter. If the positions of the first seam are shifted from the aimed positions, then the opening ornamented with the welt fabrics may be kept open at all times, or the welt fabrics are kept laid over each other on both sides of the opening; that is, the resultant product is poor in external appearance.

SUMMARY OF THE INVENTION

In view of the foregoing, an object of the invention is to provide a welt forming device with which welts high in quality can be formed irrespective of the kind of fabric at all times in such a manner that, in each of the welts, the sewed part is equal in the number of fabric layers to the exposed part, and the surface of the base fabric is flush with the surface of the welt fabric.

In order to achieve the object, one aspect of the present invention provides a welt forming device for sewing together a base fabric and a welt fabric, the welt forming device comprising:

seam forming means including a sewing needle and a sewing machine table, for moving the sewing needle up and down to form a seam on the base and welt fabrics laid over the sewing machine table;

base fabric holding means for holding the base fabric flat on the sewing machine table at all times and moving the base fabric in a sewing direction;

welt fabric holding means for fixedly holding the welt fabric on the base fabric in order to move together the welt fabric with the base fabric;

main moving means for moving the base fabric holding means and the welt fabric holding means in the sewing direction, the main moving means being moved in synchronization with the seam forming means wherein a first seam is formed to sew the base fabric and the welt fabric together;

first welt fabric folding means for folding one side portion of the welt fabric along the first seam over the other side portion thereof;

second welt fabric holding means for folding the other side portion of the welt fabric over the one side portion of the welt fabric folded by the first welt fabric holding means; and auxiliary moving means for moving the relative position of the base fabric holding means and the sewing needle in a predetermined direction across the sewing direction, the auxiliary moving means moving the welt fabric folded by the first and second welt fabric folding means and the base fabric to which the welt fabric is sewed parallel with respect to the sewing needle, wherein the seam forming means is operated in synchronization with the main moving means, and wherein a second seam is formed in parallel with the first seam to sew the other side portion of the welt fabric to the base fabric.

In the device, the auxiliary moving means may be such that the sewing needle is horizontally moved with the base fabric holding means fixed in the predetermined direction which is across the sewing direction, or the base fabric holding means is horizontally moved with the sewing needle fixed in position. The seam forming means may have a single sewing needle or plural sewing needles depending on the moving system of the auxiliary moving means.

Another aspect of the invention provides a fabric guide for a sewing machine comprising:

a bottom surface;

a rise portion upwardly extending from one end of the bottom portion, the rise portion provided in a direction across the sewing direction in part serving as a folding part and provided in parallel with the sewing direction in part serving as a holding part; and a flat portion horizontally extending from one end of the rise portion, wherein the fabric guide is moved backwardly while one end portion of a work is abutted against the rise portion for gradually folding the one end portion of the work over the upper surface of the work beginning with the front edge of the work, and then leading the front edge of the work into the holding part to maintain the work folded.

In the welt forming device, a base fabric is held by the base fabric holding means, and a welt fabric is held flat on the base fabric by the welt fabric holding means. Those two holding means are moved in a seam forming direction by the main moving means, so that a first seam is formed to sew the welt fabric to the base fabric. Thereafter, one side portion of the welt fabric is folded by the first folding means, and then the other side portion of the welt fabric is folded over the one side portion by the second folding means. And, the welt fabric holding means and the base fabric holding means, or the sewing machine body is moved in a predetermined direction which is across the seam forming direction, to change the relative position of the sewing needle and the base fabric and the welt fabric. Under this condition, the main moving means is operated again in synchronization with the vertical operation of the sewing needle, to form a second seam near and along the first seam in such a manner that it is in parallel with the first seam. In this sewing operation, the base fabric holding means changes the relative position of the base fabric and the sewing needle while maintaining the base fabric flat at all times. Hence, with the device of the invention, the first and second seam are formed at the aimed positions no matter what the material of the base fabric is.

The fabric guide of the invention functions as follows: With the rear end of one side portion of a fabric to be folded abutted against the rise portion of the folding part of the fabric guide, the fabric or the fabric guide is moved in the longitudinal direction of the latter. As a result, the one side portion of the fabric is pushed upwardly while being pushed across the sewing direction, and then guided sideward by the flat portion, thus finally folded over the upper surface of the fabric. The fabric thus folded is led to the holding part, so that it is held folded by the rise portion and the flat portion of the holding part.

BRIEF DESCRIPTION OF THE DRAWINGS

FIG. 3(*b*) is a perspective view showing a mechanism for moving a sewing machine body shown in FIG. 3(*a*);

FIG. 4(*b*) is an explanatory perspective view showing how a fabric is folded with the fabric guide shown in FIG. 4(*a*);

FIG. 5(*b*) is an explanatory perspective view for a description of the formation of a first right seam, FIGS. 5(*a*) to 5(*b*) showing a procedure of forming welts with the welt forming device shown in FIG. 1;

FIG. 6(*b*) is an explanatory perspective view showing the right welt fabric which has been folded, FIGS. 6(*a*) and 6(*b*) also showing the procedure of forming welts with the weld forming device shown in FIG. 1;

FIG. 7(*b*) is an explanatory perspective view showing the left welt fabric which has been folded, FIGS. 7(*a*) and 7(*b*) also showing the procedure of forming welts with the welt forming device shown in FIG. 1;

FIG. 12(*b*) is a perspective view showing a moving mechanism for a sewing machine body shown in FIG. 12(*a*);

FIG. 13(*b*) is also a fragmentary perspective view showing the formation of a first right seam, FIGS. 13(*a*) and 13(*b*) is for a description of a procedure of sewing seam with the welt forming device shown in FIGS. 12(*a*) and 12(*b*);

FIG. 14(*b*) is also an explanatory perspective view showing welt fabrics which have been folded;

FIGS. 22(*b*) through 22(*e*) are explanatory perspective views for a description of a procedure of forming the welt shown in FIG. 22(*a*);

DETAILED DESCRIPTION OF THE PREFERRED EMBODIMENTS

Figure 1:
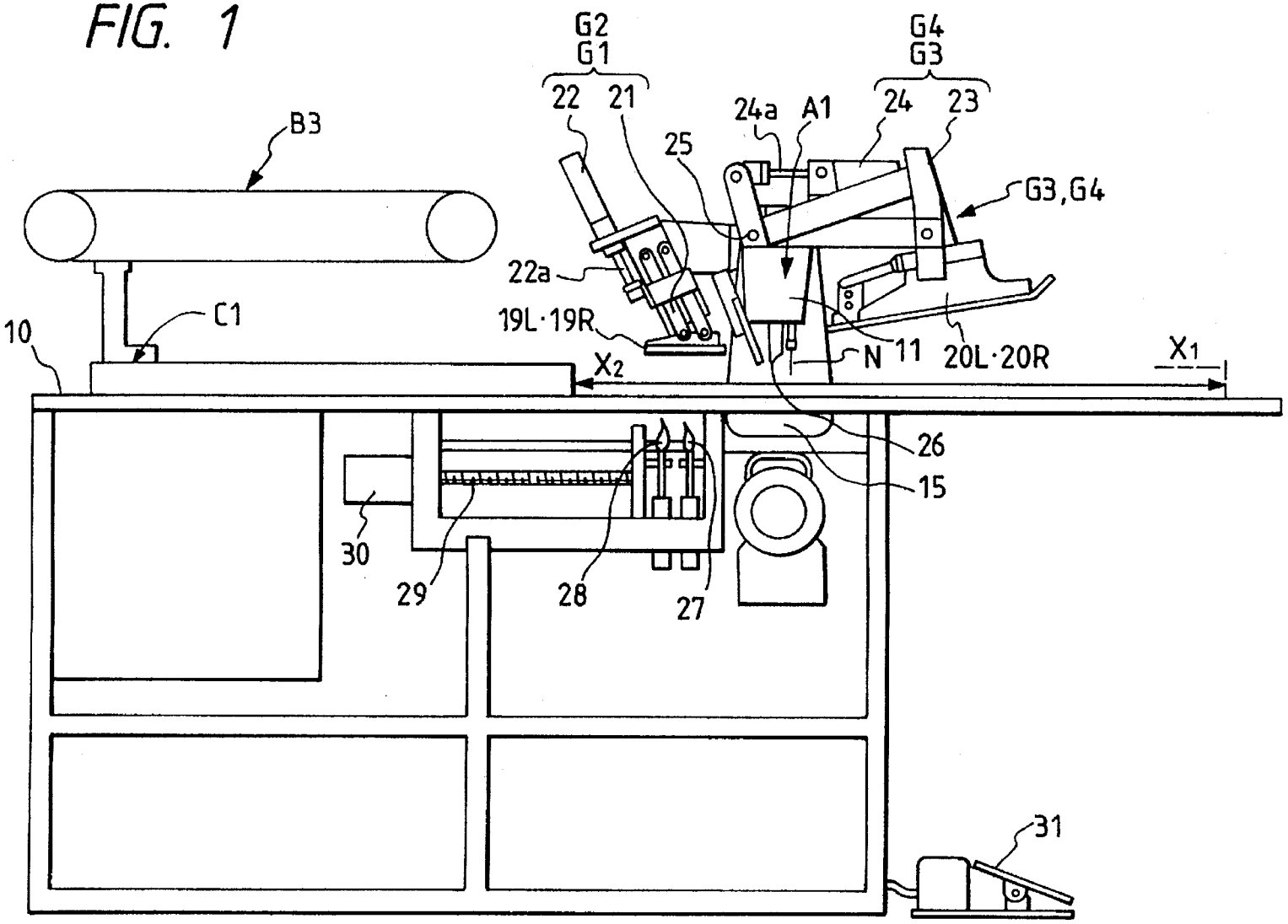
FIG. 1 is a side view showing a welt forming device, according to a first embodiment of this invention.

Preferred embodiments of the invention will be described with reference to the accompanying drawings.

FIGS. 1 through 11 show a welt forming device, according to a first embodiment of the invention.

In those figures, a sewing machine body A1, serving as seam forming means, supported on a sewing machine table 10. The sewing machine body A1 comprises: a sewing machine arm 11 accommodating a seam forming mechanism which moves a sewing needle N up and down; and a sewing machine bed 15 having, for instance, a shuttle race which is rotated in synchronization with the sewing needle. The sewing machine body A1 is so supported on the sewing machine table such that it is movable in a horizontal direction (or an auxiliary movement direction) Y which is perpendicular to a sewing direction X1. The sewing machine bed 15 is supported by guide members 101*a*, 101*b*, 102*a* and 102*b*. The guide members 101*a* and 101*b* on one side are locked to a guide member 100 supported by the sewing machine table 10, and the guide members 102*a* and 102*b* on the other side are locked to supporting members 103*a* and 103*b* which are rotatably supported by the sewing machine table 10. The guide member 102*b* is engaged with an endless belt 13 which is driven by a pulse motor 12.

Hence, the sewing machine body A1 is locked at a predetermined position by the endless belt 13 which is driven by the pulse motor 12. As the belt 13 is driven, the sewing machine body A1 is moved in the auxiliary movement direction Y (or in a right-to-left direction) with respect to a fabric placed on the sewing machine table 10. The pulse motor 12 and the belt 13 form auxiliary moving means B1 which moves the sewing machine body A1 in the auxiliary movement direction with respect to a fabric on the sewing machine table 10.

Base fabric holding means C1 holds a base fabric W1 on the sewing machine body 10. The base fabric holding means C1 comprises a pair of right and left base fabric retainers 14R and 14L which are symmetrical in arrangement as viewed in the right-to-left direction (or in the auxiliary movement direction). The base fabric holding means C1 can be moved in the sewing direction X1 and in the opposite direction X2 with conventional moving means B3 driven by a servo motor through a timing belt, and can be moved vertically with lifting means (not shown).

The base fabric retainers 14R and 14L are provided with folding plates 17R and 17L, respectively, which are movable back and forth. The folding plates 17R and 17L form welt fabric folding means D. The base fabric retainers 14R and 14L are further provided with welt fabric retainers 18R and 18L, respectively, which are vertically movable. The welt fabric retainers 18R and 18L form welt fabric holding means E. The welt fabric holding means E together with the two base fabric retainers 14R and 14L is moved back and forth, and is vertically movable between the position where welt fabrics are held laid on a base fabric and a predetermined retracting position.

Figure 4A:
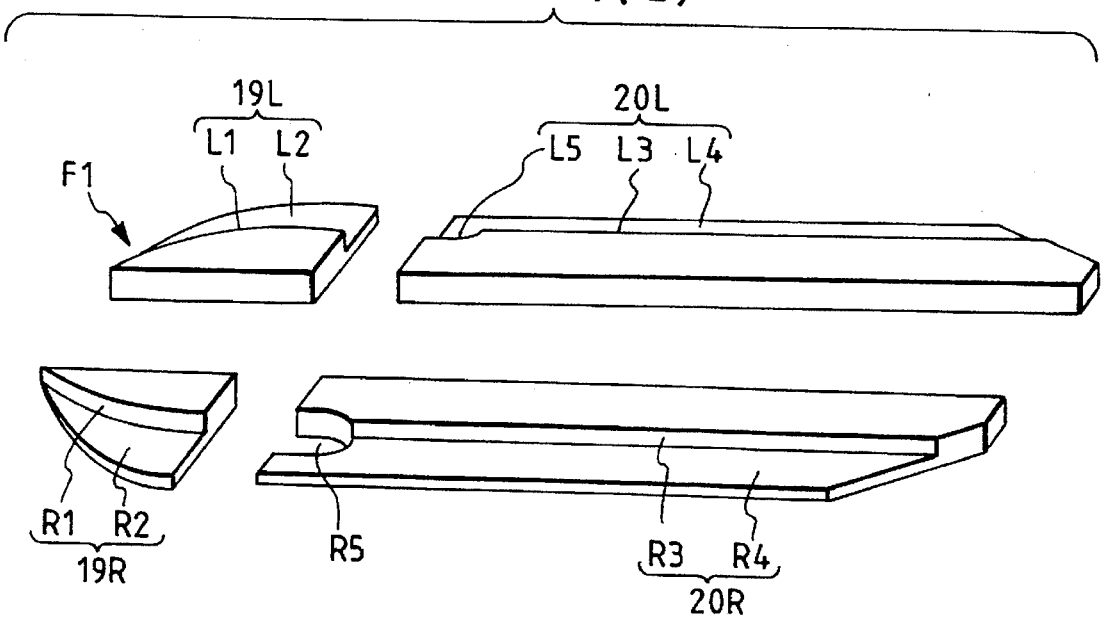
FIG. 4(*a*) is a perspective view showing the configuration of the bottom of a fabric guide employed as the first folding means shown in FIG. 3.
Figure 4B:
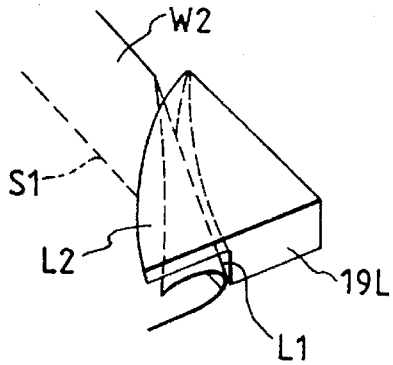

First welt fabric folding means F folds one side portion of each of the welt fabrics sewed to the base fabric over the other side portion. The first welt fabric folding means F comprises: a fabric guide F1 which is made up of four pieces 19R and 19L and 20R and 20L arranged as shown in FIG. 4(*a*); and lifting means G1, G2, G3 and G4 for vertically moving those pieces independently of one another. In the first welt fabric folding means F, the two pieces 19R and 19L are located ahead of the remaining two pieces 20R and 20L as viewed in the fabric feeding direction. Each of the two pieces 19R and 19L is adapted to fold one side portion of a welt fabric sewed to a base fabric over the other side portion. The two pieces 19R and 19L are axially symmetrical in configuration. Hereinafter, the two pieces 19R and 19L will be referred to as "folding parts 19R and 19L", when applicable. The remaining two pieces 20R and 20L are to maintain the fabrics as they are which have been folded by the folding parts 19R and 19L. Those pieces 20R and 20L are also axially symmetrical in configuration. Hereinafter, the pieces 20R and 20L will be referred to as "holding parts 20R and 20L", when applicable.

The lifting means G1, G2, G3 and G4 operating independently of one another are provided for the folding parts 19L and 19R and the holding parts 20L and 20R, respectively. The lifting means G1 and G2 provided for the folding parts 19L and 19R are axially symmetrical in arrangement, and the lifting means G3 and G4 provided for the holding parts 20L and 20R are also axially symmetrical in arrangement.

The lifting means G1 (or G2) for vertically moving the folding part 19L (or 19R) comprises: a supporting member 21 which is adapted to support the respective folding part 19L (or 19R); and an air cylinder 22 adapted to move the supporting member 20 obliquely upwardly as viewed in the front-to-rear direction. When the cylinder rod 22*a* of the air cylinder 22 is protruded, the folding part 19L (or 19R) is lowered slightly ahead of the needle drop position on the sewing machine bed 15.

The lifting means G3 (or G4) for vertically moving the holding part 20L (or 20R) comprises: a rotary member 23 which is rotatably supported through a shaft 25 on the sewing machine arm 11 and supports the holding part 20L (or 20R); and an air cylinder 24 adapted to turn the rotary member 23. When the cylinder rod 24*a* of the air cylinder 24 is protruded, the folding part 19L (or 19R) together with the rotary member 23 is turned downwardly, thus being lowered slightly behind the needle drop position on the sewing machine bed 15.

The bottoms of the folding parts 19L and 19R and the holding parts 20L and 20R forming the fabric guide have steps as shown in FIG. 4(*a*).

That is, the bottom of the folding part 19L (or 19R) has a step which is defined by a rise portion L1 (or R1) which is extended upwardly and a flat portion L2 (or R2) formed on the top of the rise portion L1 (or R1). The rise portion L1 (or R1) is curved, while being protruded sideward from the front end to the rear end as viewed in the sewing direction. The flat portion L2 (or R2) is also curved, while being protruded more sideward than the rise portion L1 (or R1).

The bottom of the holding part 20L (or 20R) also has a step which is defined by a rise portion L3 (or R3) which is extended upwardly and by a flat portion L4 (or R4) formed on top of the rise portion. The rise portion L3 (or R3), and the flat portion L4 (or R4) are extended linearly in the sewing direction. The holding part 20L (or 20R) has a needle drop groove L5 (or R5) in its front end portion into which the sewing needle N is dropped.

Figure 2:
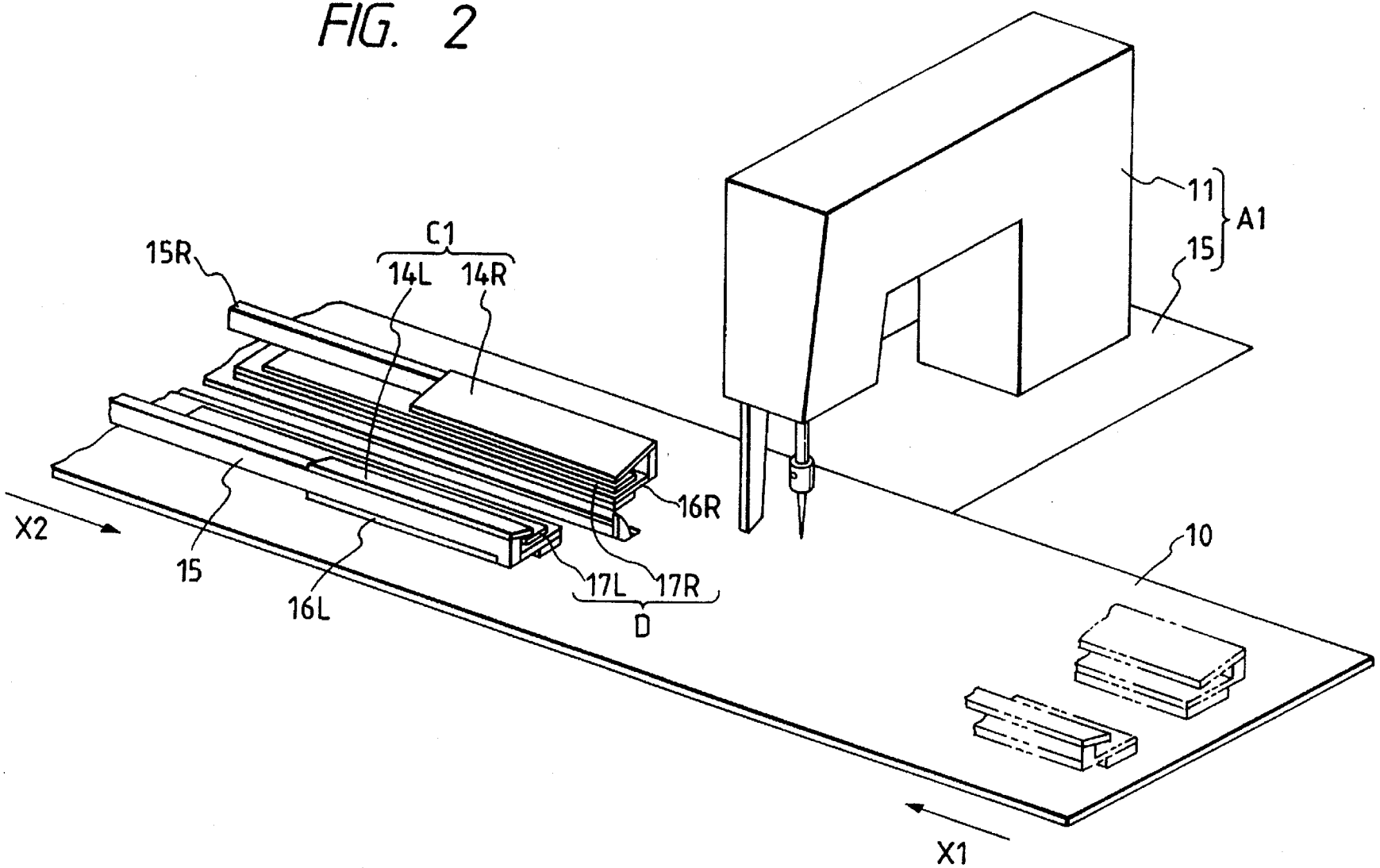
FIG. 2 is a perspective view of base fabric holding means shown in FIG. 1.

In FIGS. 1 and 2, a center knife (or blade) 26 is used to cut a base fabric laid on the sewing machine table to form an opening (or a slot) for a pocket. A pair of corner knives (or blades) 27 and 28 are used to form V-shaped cuts at both ends of the opening formed with the center knife 26. One of the corner knives, namely, the corner knife 28 can be moved back and forth by turning a ball threaded spindle 29 with an electric motor 30. That is, the corner knife 28 is moved according to the length of the pocket opening cut with the center knife.

In FIG. 1, a control pedal 31 gives various instructions such as for instance a sewing operation starting instruction.

Now, the operation of the welt forming device thus organized, the first embodiment of the invention, will be described with reference to the case where welts are formed on both edges of a pocket opening formed in a base fabric.

Figure 5A:
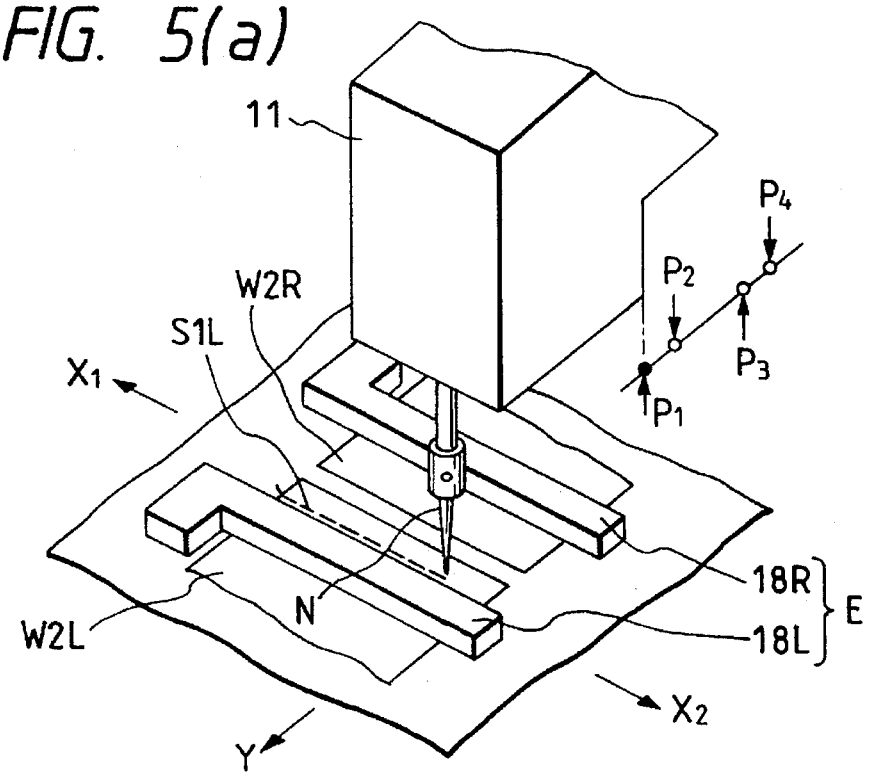
FIG. 5(*a*) is an explanatory perspective view for a description of the formation of a first left seam.
Figure 5B:
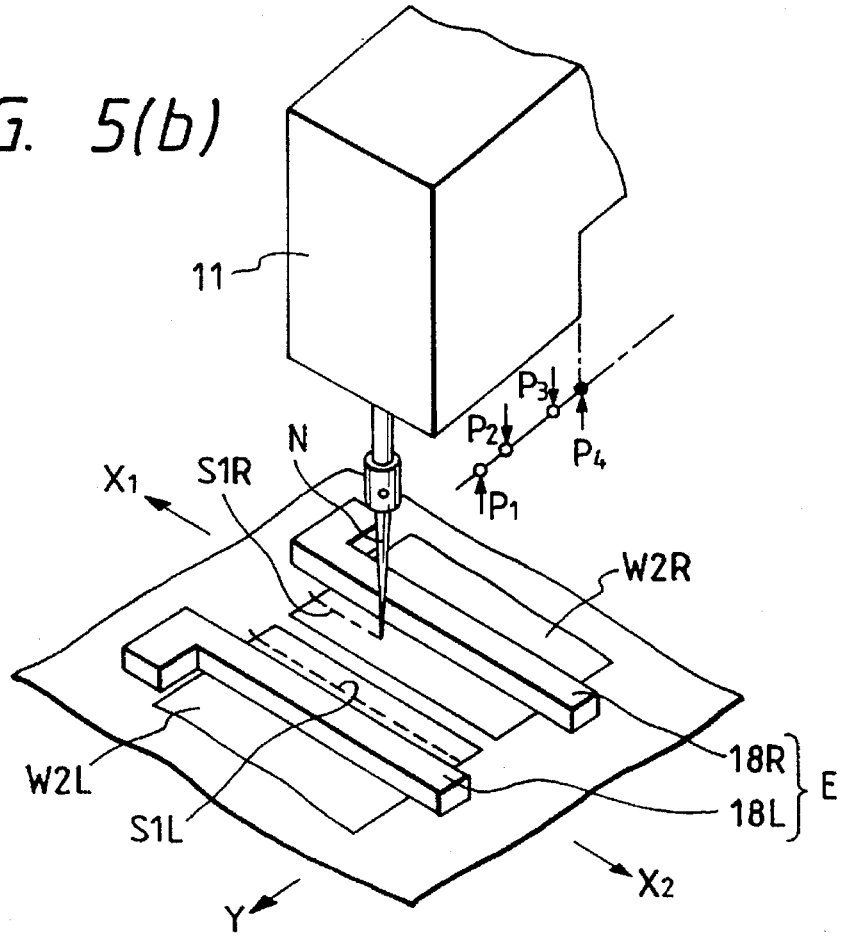

Initially, the base fabric retainers 14L and 14R, the welt fabric retainers 18L and 18R, and the fabric guide F1 are held above the sewing machine table 10, and the sewing machine arm 11, as shown in FIG. 5(*a*), is located at a planned sewing position (a first position) P1 where the sewing needle N comes leftmost.

Under this condition, the operator performs the following work: A base fabric W1 is placed on the sewing machine table 10, and after the position where a pocket opening should be formed (hereinafter referred to as "a pocket opening planned position", when applicable) is aligned with a marking light (not shown), the base fabric W1 is held on the sewing machine table 10 with the base fabric retainers 14L and 14R in such a manner that the base fabric W1 is held stretched (not being slackened). A pair of welt fabrics W2L and W2R are placed on the base fabric W1 in such a manner that they are positioned symmetrical on both sides of the planned pocket opening position. Under this condition, the welt fabric retainers 18L and 18R are moved downwardly to fixedly hold the welt fabrics W2L and W2R on the base fabric W1 as shown in FIG. 5(*a*).

Under this condition, the control pedal is operated to give a sewing operation starting instruction. In response to the instruction, the base fabric retainers 14L and 14R and the welt fabric retainers 18L and 18R are linearly moved in the sewing direction X1 from the initial positions (indicated by one-dot chain lines in FIG. 2) located before the needle drop position. When the welt fabrics W2L and W2R reach the needle drop position, the sewing needle N starts its vertical operation, thus forming a seam S1L (a first left seam) on the left welt fabric W2L as shown in FIG. 5(*a*).

After the formation of the first left seam S1L on the left welt fabric W2L, the left welt fabric retainer 18L is lifted while the base fabric retains 14L and 14R are moved in the direction X2 which is opposite to the sewing direction X1, so that the base fabric W1 and the welt fabric W2R are returned to the sewing start position. At the same time, the pulse motor 12 is operated to drive the belt 13 thereby to move the sewing machine arm 11 to the right, so that the sewing needle N is set at a planned sewing position (a fourth position) P4 for the right welt fabric W2R. Thereafter, in synchronization with the up and down operation of the sewing needle N, the base fabric retainers 14L and 14R and the welt fabric retainer 18R are moved together, as a result of which a seam S1R (a first right seam) is formed on the welt fabric W2R as shown in FIG. 5(*b*).

Figure 6A:
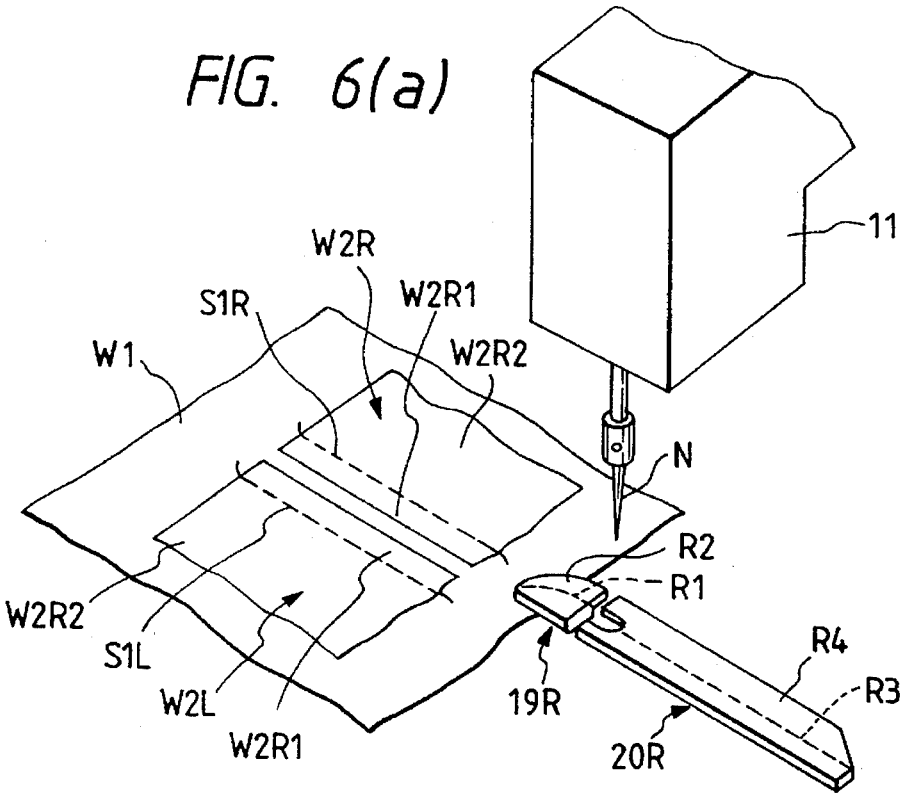
FIG. 6(*a*) is an explanatory perspective view showing a right folding part and a right holding part which are lowered on the sewing machine table.
Figure 6B:
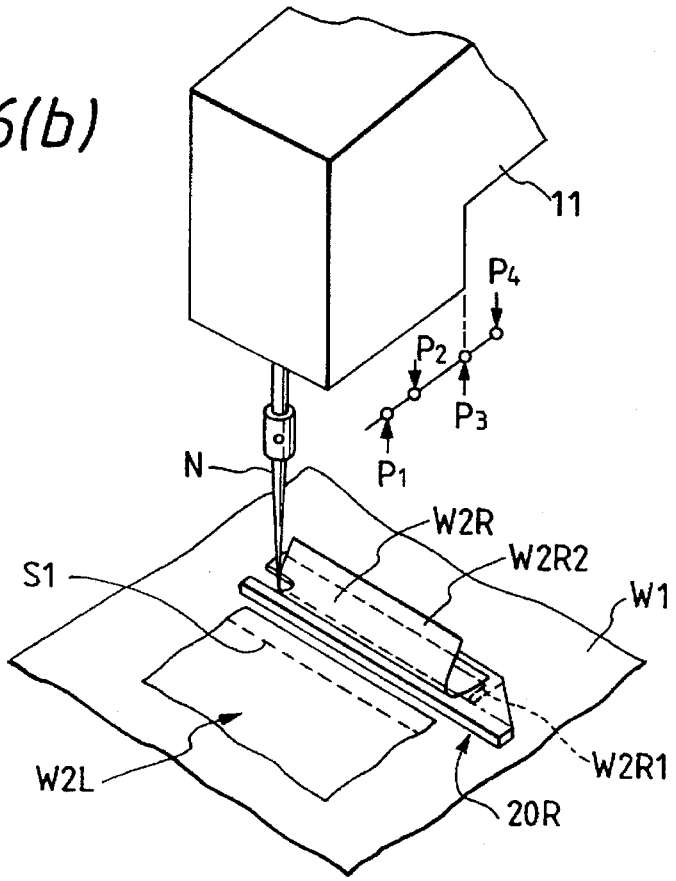

When the two welt fabrics W2L and W2R are sewed to the base fabric W1, and the right welt fabric retainer 18R is lifted, then the right folding part 19R and the right holding part 20R of the fabric guide F1 are lowered onto the base fabric W1 by the air cylinders 22 and 24 of the lifting means as shown in FIG. 6(*a*). In this connection, it should be noted that the welt forming device is so designed that the fabric guide F1 is lowered to the extent that the lower surface of the fabric guide F1 is brought lightly in contact with the upper surface of the base fabric W1, or slightly spaced from it.

The base fabric retainers 14L and 14R are moved in the direction X2 opposite to the sewing direction X1; that is, the welt fabrics W2L and W2R together with the base fabric W1 are moved in the direction X2. As a result, the rear end of one side portion W2R1 of the right welt fabric W2R is brought into contact with the front end of the rise portion R1 of the right folding part 19R. As the base fabric retainers 14L and 14R are further moved backwardly, the one side portion W2R1 of the welt fabric W2R, being moved along the rise portion R1, is gradually pushed upwardly while being pushed to the left. Thereafter, the one side portion W2R1 is guided sideward being abutted against the flat portion R2. As a result, the one side portion W2R1 of the welt fabric W2R is bent along the first right seam S1R formed before, thus being folded over the upper surface of the other side portion (or the remaining portion) W2R2 of the welt fabric W2R as shown in FIG. 4(*b*). Thus, three layers of fabric have been formed.

The right welt fabric W2R thus folded is led to the holding part 20R following the folding part 19R, so that the welt fabric W2R is held folded as shown in FIG. 6(*b*). Under this condition, the right folding part 19R is retracted upwardly by the air cylinder 22.

Figure 9:
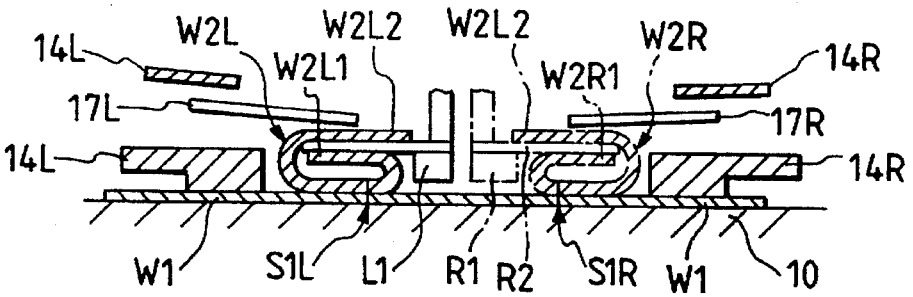
FIG. 9 is a fragmentary sectional view showing the second welt folding step in which the other side portion of each of the welt fabrics which have been folded as shown in FIG. 8 is folded over the one side portion.

Thereafter, the folding plate 17R provided for the right base fabric retainer 14R is protruded outwardly by driving means (not shown), so that the other side portion W2R2 of the welt fabric W2 laid over the upper surface of the base fabric retainer 14R is folded over the one side portion W2R1 as shown in FIG. 9 and FIG. 6(*b*).

Next, the pulse motor 12 is operated to move the sewing machine body A1 to a planned sewing position (or a third position) P3, so that the sewing needle N is slightly shifted from the first right seam which has been formed before. Under this condition, the sewing needle N is moved up and down while the base fabric retainers 14L and 14R are moved in the sewing direction, so that, while the sewing needle N is being dropped into the needle drop groove R5 formed in the end portion of the holding part 20R, a seam (or a second right seam) S2R is formed to sew the other side portion W2R2 of the welt fabric W2R to the base fabric W1. The seam S2R thus formed is located on the left side of the first right seam S1R in such a manner that it is near the first right seam S1R and in parallel with the latter S1R.

Figure 7A:
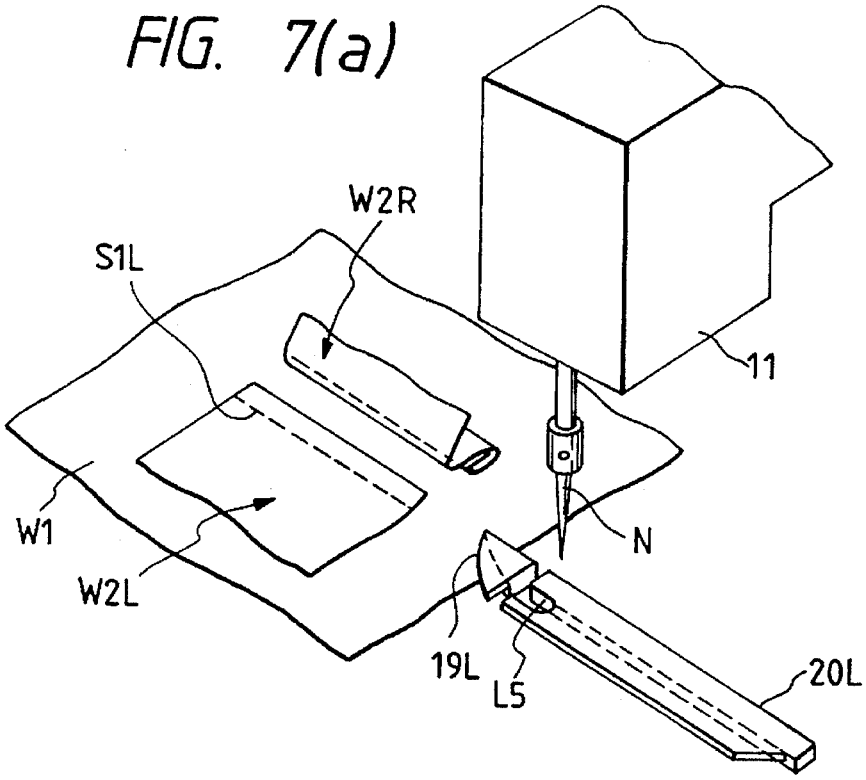
FIG. 7(*a*) is an explanatory perspective view showing a left folding part and a left holding part which are lowered on the sewing machine table.
Figure 7B:
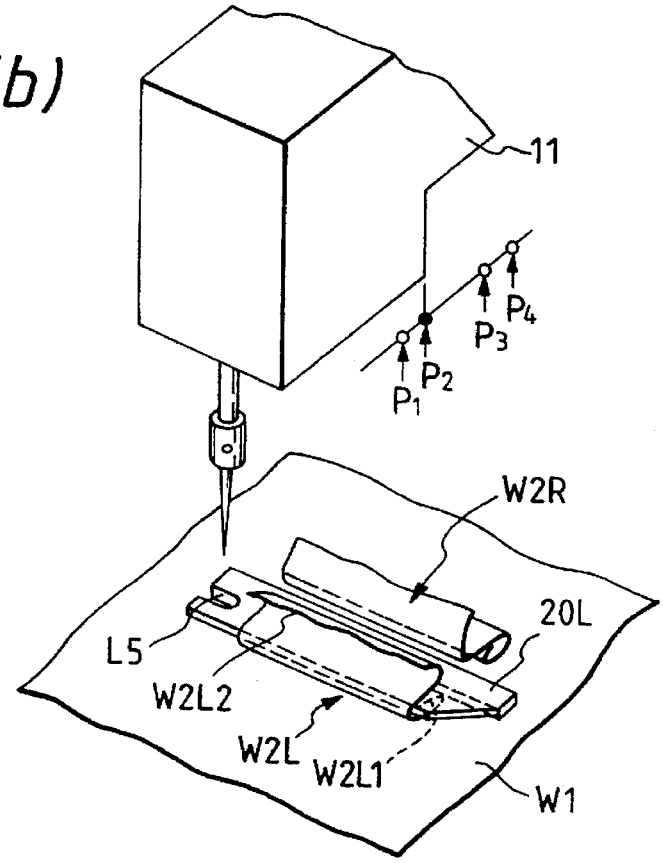
Figure 8:
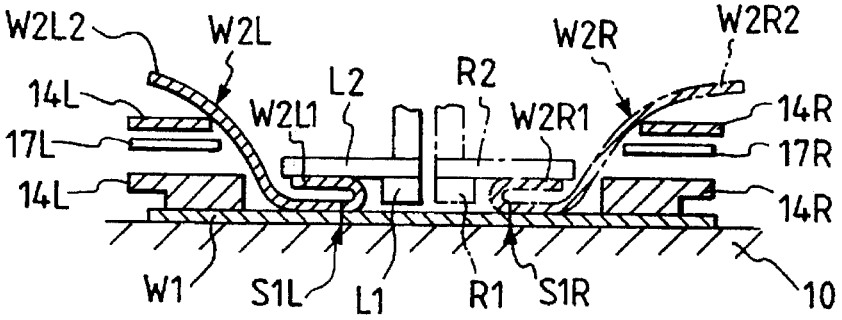
FIG. 8 is a fragmentary sectional view showing the first welt folding step in which one side portion of each of the welt fabrics is folded over the other side portion.

After the right welt fabric W2R has been sewed in the above-described manner, the air cylinder 24 is stopped, so that the right holding part 20R is retracted upwardly, while the air cylinders 22 and 24 of the lifting means G1 and G3 provided for the left folding part 19L and the left holding part 20L are operated to lower the folding parts 19L and 19R and the holding parts 20L and 20R onto the base fabric W1 as shown in FIG. 7(*a*).

At the same time, the pulse motor 12 is operated, so that the sewing machine body A1 is moved to a planned sewing position (or a second position) P2 on the left side so that the sewing needle N is dropped substantially on the left side of the first left seam S1L formed before. Similarly as in the above-described case, the welt fabrics W2L and W2R together with the base fabric W1 are moved in the opposite direction X2 by the base fabric retainers 14L and 14R, so that, similarly as in the case of the right welt fabric W2R, the left welt fabric W2L is folded along the first left seam S1L by the folding part 19L, and the left welt fabric W2L is held folded by the holding parts 20L and 20R. Thereafter, the folding parts 19L and 19R are moved upwardly as shown in FIG. 7(*b*).

Figure 10:
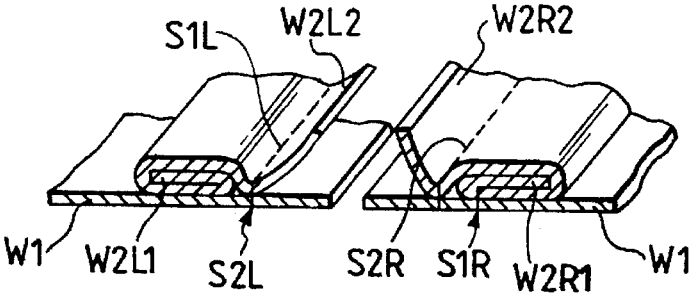
FIG. 10 is a sectional perspective view showing the formation of second seam on the welt fabrics.

In synchronization with the operation of the sewing needle N, the base fabric retainers 14L and 14R are moved in the sewing direction X1, so that a second left seam S2L as shown in FIG. 10 is formed on the right side of the first left seam S1L in such a manner that it is located near the first left seam S1L and in parallel with the latter S1L. On the other hand, the center knife 26 is operated to cut the middle portion of the base fabric W1 as much as the length of a pocket opening to be formed thereat, and the corner knives 27 and 28 are operated to form V-shaped cuts at both ends of the pocket opening thus formed.

Figure 11:
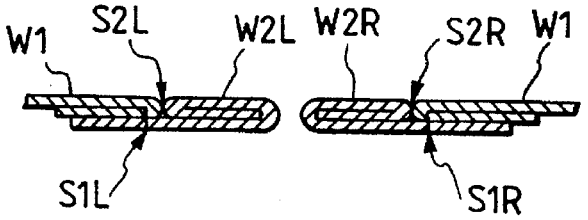
FIG. 11 is a sectional view showing the welts which have been formed by turning over the welt fabrics which have been folded and sewed as shown in FIG. 10.

Thus, the right and left welts have been formed for the pocket opening. The base fabric retainers 14L and 14R and the other driving means are reset. The welt fabrics W2L and W2R together with the base fabric W1 are removed from the sewing machine table 10, and they are turned about 180° about the first left and right seam S1L and S1R, respectively. The welts thus formed are excellent in external appearance. That is, as shown in FIG. 11(*a*), the sewed part and the exposed part of each of the welts formed by sewing the welt fabrics W2L and W2R to the base fabric W1 are equal in the number of layers of fabric to each other, and the surface of the base fabric W1 and the surfaces of the welt fabrics W2L and W2R are flush with one another.

As was described above, in forming the four seams S1L, S1R, S2L and S2R, the relative position of the swing needle N and the fabrics W to be sewed in the transverse direction (or in the direction Y) is changed by moving the sewing machine body A1 in the transverse direction. Hence, in the above-described first embodiment, those seams can be formed at the correct positions irrespective of the thickness, stiffness, etc. of the fabric employed.

In addition, in the first embodiment, the side portions W2L1 and W2R1 of the welt fabrics W2L and W2R are folded merely by abutting the latter W2L and W2R against the fabric guide F1. Hence, the first embodiment is free from the difficulty accompanying the conventional device that the latter has the mechanism and the actuator which are used only for the first folding operation. Accordingly, the welt forming device of the invention is simpler in construction and much lower in manufacturing cost than the conventional one.

A second embodiment of the invention will be described with reference to FIGS. 12 through 14.

In the second embodiment, a so-called "two-needle type sewing machine" which is able to form two seams at the same time is employed as a sewing machine body A2, and the sewing machine body A2 is moved in a direction perpendicular to the sewing direction.

In the sewing machine body A2, the sewing machine arm 31 has two needle bars which hold two sewing needles NL and NR, respectively, and the sewing machine bed 15 accommodates shuttle races and other parts which operate in association with the sewing needles NL and NR. Those components form a pair of seam forming means.

The pair of seam forming means are so designed that they are able to move both the two sewing needles NL and NR up and down, and to move one of the needles with the aid of a conventional one-needle stopping mechanism. The sewing machine bed 15 is movable with respect to the sewing machine table 10 in a direction Y perpendicular to the sewing direction. More specifically, the sewing machine bed 15 is able to take first, second and third positions P1, P2 and P3 with the aid of auxiliary moving means B2, namely, an air cylinder 32.

The air cylinder 32 has two cylinder rods 32*a* and 32*b* which can be protruded in the opposite directions independently of each other. The cylinder rod 32*a* is secured to the sewing machine table 10, and the cylinder rod 32*b* is secured to the sewing machine bed 15.

In the second embodiment, its fabric guide F2 is made up of two separate parts, namely, a folding part 39 and a holding part 40. The folding part 39 is made up of a pair of curved rise portions LR1 which are axially symmetrical in configuration, and a pair of curved flat portions LR2 which are also axially symmetrical in configuration. The holding part 40 is made up of a pair of rise portions LR3 which are linearly extended, and a pair of flat portion LR4 which are also linearly extended. That is, the folding part 39 is substantially equal in configuration to that which is obtained by joining the right and left folding parts 19R and 19L in the first embodiment, and the holding part 40 is substantially equal in configuration to that which is obtained by joining the right and left holding parts 20R and 20L in the first embodiment. The other arrangements are equal to those in the first embodiment.

Figure 13A:
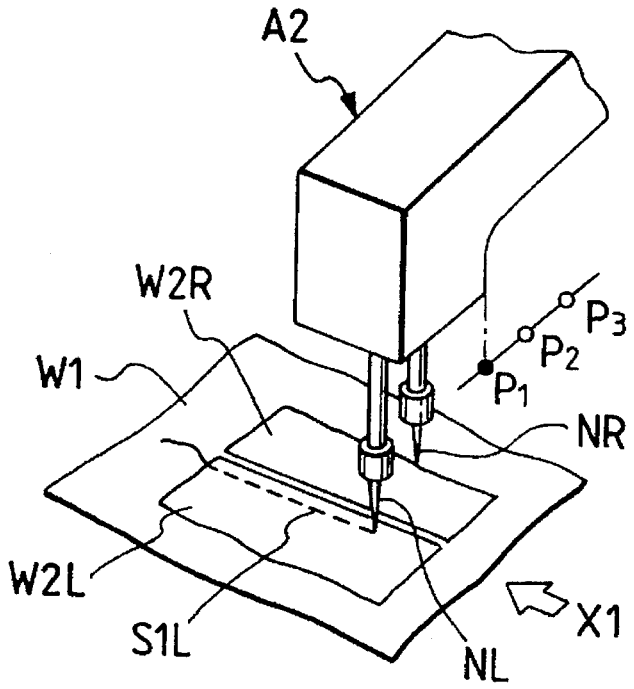
FIG. 13(*a*) is a fragmentary perspective view showing the formation of a first left seam.
Figure 13B:
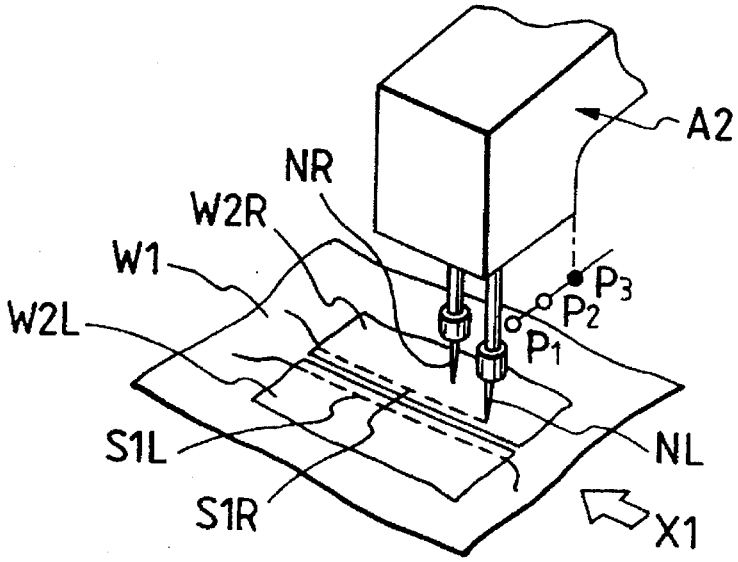

The welt forming device thus constructed performs a sewing operation according to a procedure shown in FIGS. 13(*a*), 13(*b*), 14(*a*), 14(*b*) and 14(*c*).

Figure 12A:
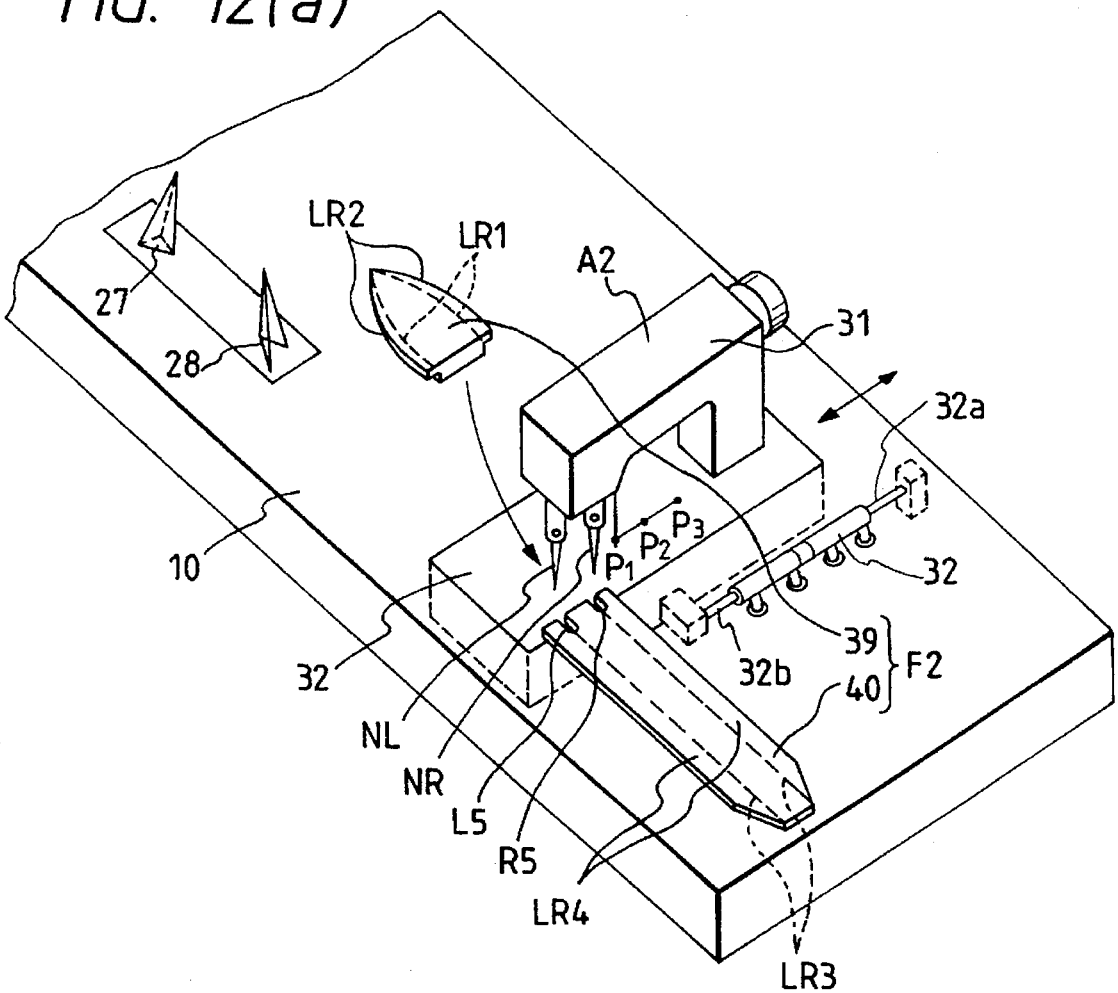
FIG. 12(*a*) is an explanatory perspective view showing another welt forming device, according to a second embodiment of the invention.
Figure 12B:
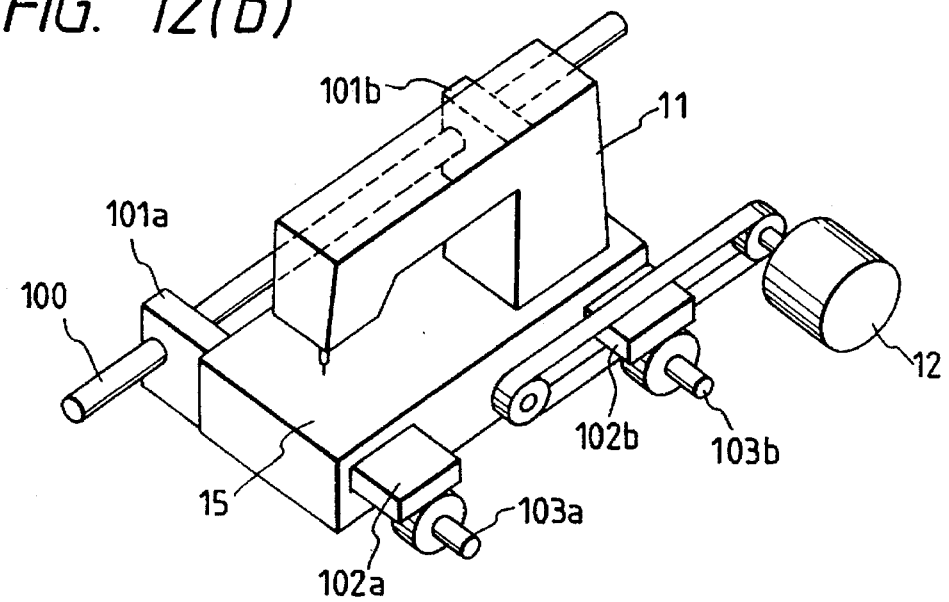

Initially, the cylinder rods 32*a* and 32*b* of the air cylinder 32 are held protruded, and the sewing machine body A2 is set at a first position P1 which is the leftmost position in FIG. 12(*a*). Similarly as in the first embodiment, a base fabric W1 and a pair of welt fabrics W2L and W2R are set at a sewing start position with the base fabric retainers 14R and 14L (not shown) and the welt fabric retainers 18R and 18L (not shown). Under this condition, a sewing operation starting instruction is issued. In response to the instruction, only the left sewing needle N1 is moved up and down, while the base fabric W1 is moved in the sewing direction by the base fabric retainers 14R and 14L, so that a first left seam S1L is formed on the left welt fabric W2L.

After the first left seam S1L has been formed, the base fabric retainers 14R and 14L and the welt fabric retainers 18R and 18L are moved in the opposite direction X2, so that the base fabric W1 and the welt fabrics W2R and W2L are returned to the sewing operation start position. Thereupon, the two cylinder rods 32*a* and 32*b* of the air cylinder 32 are retracted, so that the sewing machine body A2 is moved to the right to a third position P3 (as shown in FIG. 13(*b*)), and the right sewing needle NR is held at a predetermined distance from the left edge of the right welt fabric W2R. Under this condition, in response to a sewing operation starting instruction, a first right seam S1R is formed to sew the right welt fabric W2R to the base fabric W1. Thereafter, the welt fabric retainers 18R and 18L are raised.

The folding part 39 and the holding part 40 of the fabric guide F2 are moved downwardly by lifting means provided therefor. The base fabric W1 and the welt fabrics W2R and W2L are moved in the opposite direction X2 by the base fabric retainers 14R and 14L as shown in FIG. 14(*a*). As the welt fabrics W2L and W2R pass through the folding part 39, one side portion of each of the welt fabrics W2R and W2L is folded over the other side portion. The welt fabrics thus folded are led to the holding part 40, so that they are maintained folded. Under this condition, similarly as in the case of the first embodiment, second welt fabric folding means, namely, a pair of folding plates 17 are protruded, so that the other side portion of each of the welt fabrics W2R and W2L is folded over the one side portion as shown in FIG. 14(*c*).

When the first right seam S1R has been sewed, one of the cylinder rods (for instance the left cylinder rod 32*a*) of the air cylinder 32 is protruded, and the sewing machine body A2 is moved to a middle position (a second position) P2. As a result, the position of the left sewing needle NL is shifted slightly right from the first left seam S1L to the right, while the position of the right sewing needle NR is shifted slightly left from the first seam S1R.

After the other side portions of the welt fabrics W2L and W2R have been folded in the above-described manner, in response to another sewing operation start instruction the two sewing needles NL and NR are moved up and down simultaneously, so that a second left seam S2L and a second right seam S2R are formed in such a manner that they are slightly shifted from the first left seam and the first right seam, respectively; that is, the other side portions W2L2 and W2R2 of the welt fabrics W2L and W2R are sewed to the base fabric W1 at the same time.

As is apparent from the above description, in the second embodiment, too, the four seams S1L, S1R, S2L and S2R are formed at the correct positions, so that the resultant welts are excellent in quality. Furthermore, in the second embodiment, the second right seam S2R and the second left seam S2L are simultaneously formed with the right and left sewing needles NR and NL, which shortens the sewing operation cycle, and increases the productivity. In the second embodiment, the fabric guide F2 is made up of the folding part which is the combination of the folding parts 19L and 19R in the first embodiment, and the holding part which is the combination of the holding parts 20L and 20R in the first embodiment. Hence, the fabric guide F2 can be readily manufactured at low cost when compared with the fabric guide F1 in the first embodiment.

However, the second embodiment is lower in the range of application than the first embodiment. That is, in the first embodiment, the position of the sewing machine body A1, and accordingly the position of the sewing needle N can be determined as desired by operating the pulse motor 12. Hence, the first embodiment is able to handle a variety of welts which are different, for instance; in size. On the other hand, in the second embodiment, the sewing machine body A2 is set only at the three positions P1, P2 and P3. Hence, the second embodiment cannot handle all of the various welts; that is, it is limited in the range of application. If in the second embodiment, the mounting positions of the sewing needles and the shuttle races are suitably changed, then welts different in size may be handled. However, this modification takes a lot of time and labor.

Figure 15:
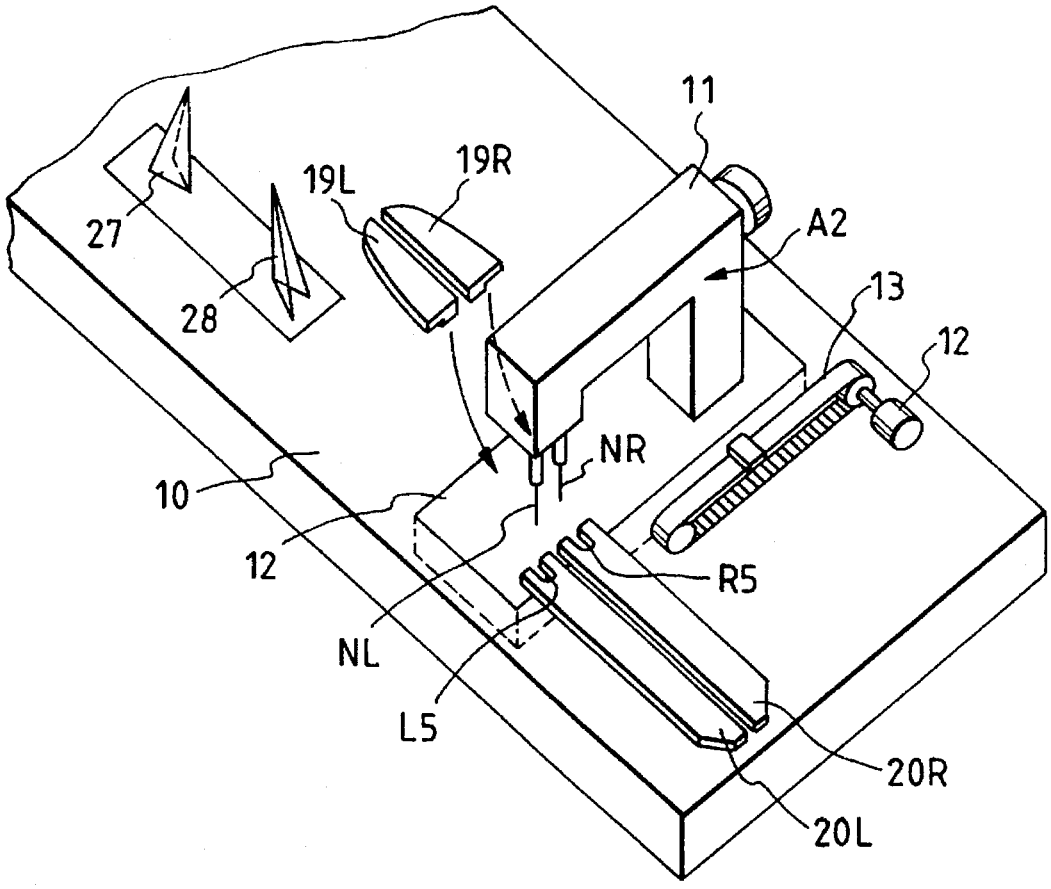
FIG. 15 is an explanatory perspective view showing another welt forming device, according to a third embodiment of the invention.

A third embodiment of the invention is as shown in FIG. 15, which is developed to have both the wide range of application of the first embodiment and the high productivity of the second embodiment.

In the third embodiment, similarly as in the case of the first embodiment, its auxiliary moving means comprises a pulse motor 12, and an endless belt 13, and its fabric guide is equal to the above-described one F1 which comprises four parts, namely, folding parts 19L and 19R and holding parts 20L and 20R, and similarly as in the case of the second embodiment a two-needle type sewing machine A2 having a one-needle stopping mechanism is employed as a sewing machine body. The other components such as for instance the base fabric retainers 14L and 14R are the same as those in the above-described second embodiment.

As is apparent from the above description, in the third embodiment, the sewing machine body A2 can be set at a desired position by operating the pulse motor 12. Hence, the sewing machine body may be used as a single-needle type sewing machine which is moved to the four positions, so that welts different in size may be handled. That is, the welt forming device is applicable to the formation of a variety of welts each of which is relatively small in number.

In the case where it is required to form a large number of welts, the first right and left seams S1R and S1L, or the second right and left seam S2R and S2L are formed with the two-needle type sewing machine simultaneously. In this case, similarly as in the case of the above-described second embodiment, the welts can be formed by performing the sewing operation three times. This means that the device is high in productivity. And, in this case, it goes without saying that the sewing machine body A2 is moved to the three positions.

Figure 3A:
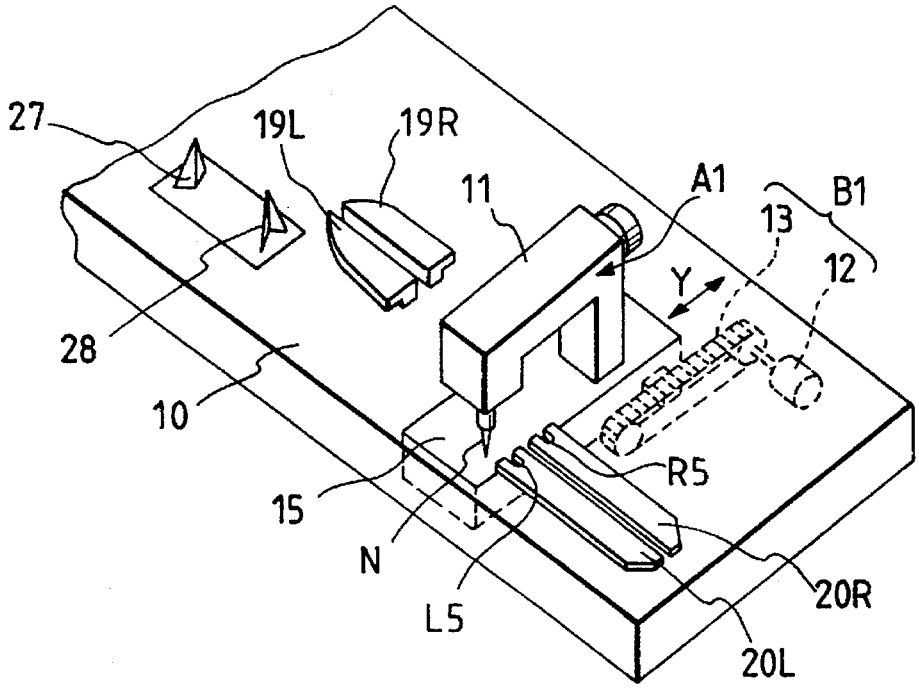
FIG. 3(*a*) is an explanatory perspective view showing auxiliary moving means and first folding means in the welt forming device shown in FIG. 1.
Figure 3B:
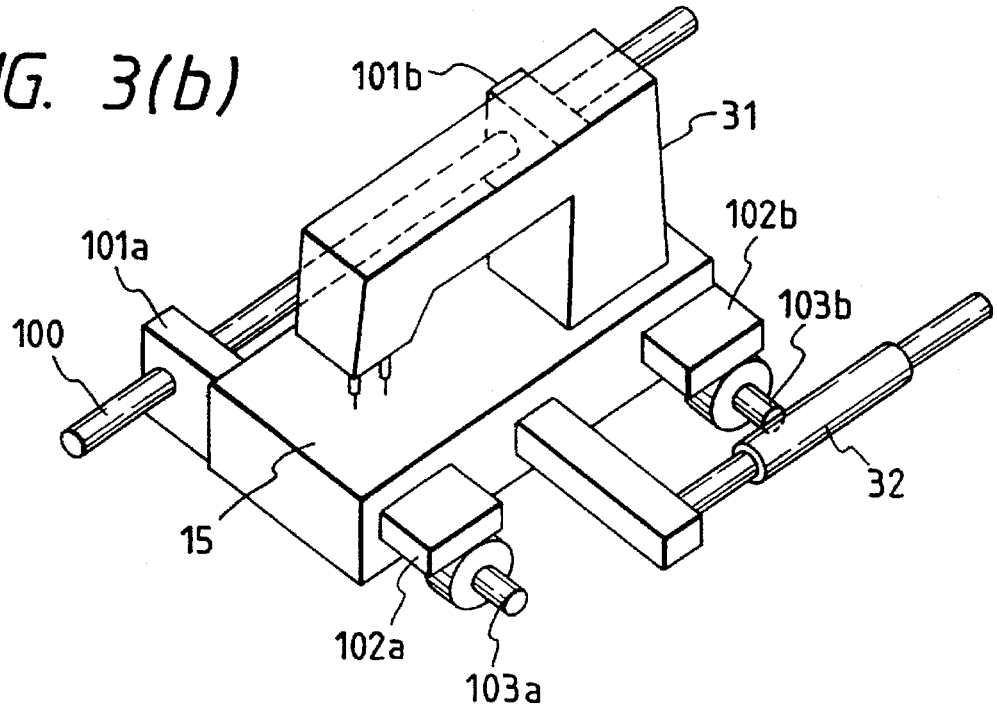
Figure 16:
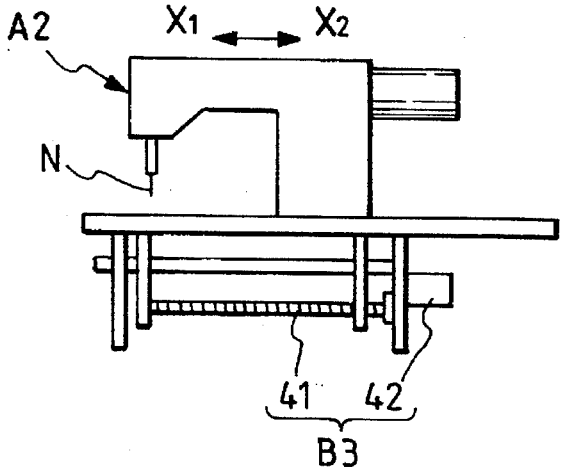
FIG. 16 is a side view showing another example of the auxiliary moving means in the welt forming device according to the invention.

Instead of the auxiliary moving mechanism as shown in FIGS. 3 and 15 which is adapted to move the sewing machine body to a desired position, one as shown in FIG. 16 may be employed. However, it should be noted that the auxiliary moving mechanism is not limited to those which have been described above. In the auxiliary moving mechanism shown in FIG. 16, a ball threaded spindle 41 is coupled to the sewing machine body A1 (or A2) in such a manner that it is extended in a lateral direction perpendicular to the sewing direction, and the ball threaded spindle 41 thus set is turned with a pulse motor or servo motor, to move the sewing machine body A1 in the lateral direction.

In the first through third embodiments of the invention, the sewing machine head is moved in the lateral direction so as to change the relative position of the sewing needle N and the fabrics W (W1, W2L and W2R) in the transverse direction. In the following fourth and fifth embodiments of the invention, the fabrics W are moved in the transverse direction to change the relative position of the sewing needle N and the fabrics W.

Figure 17:
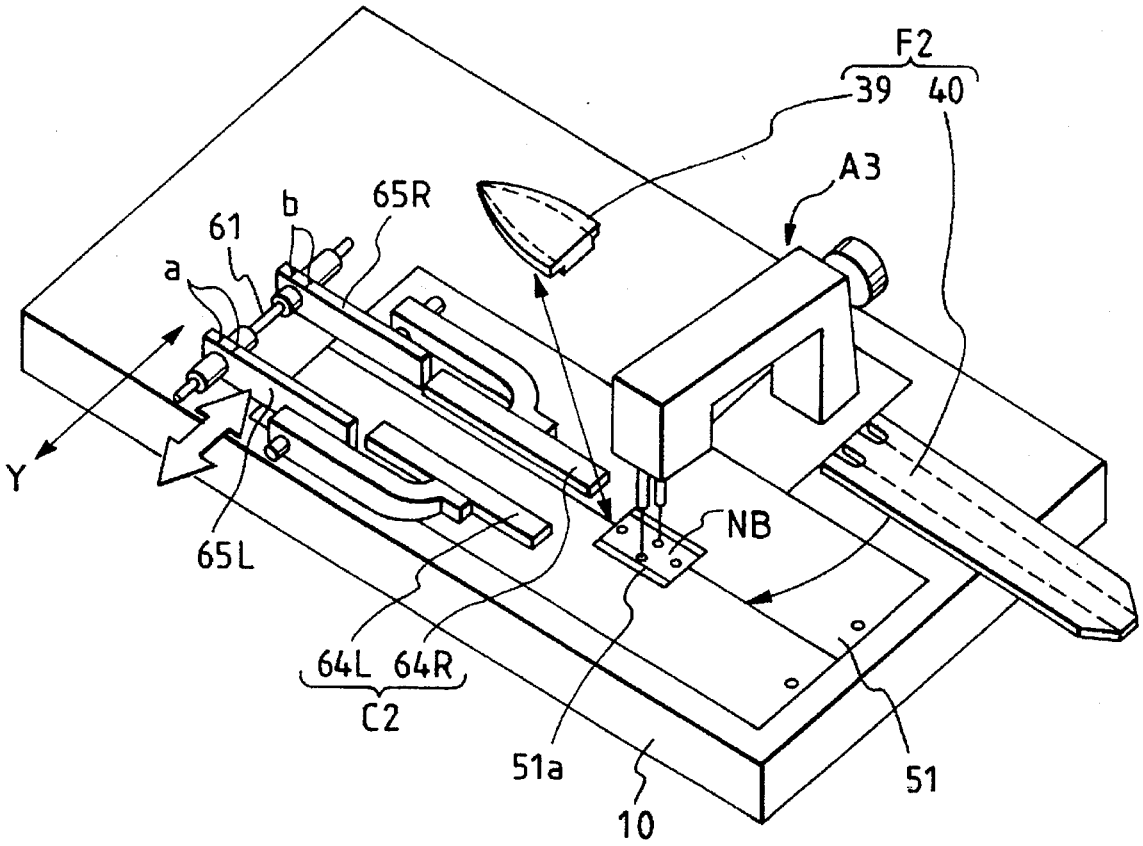
FIG. 17 is an explanatory perspective view showing another welt forming device, according to a fourth embodiment of the invention.
Figure 18:
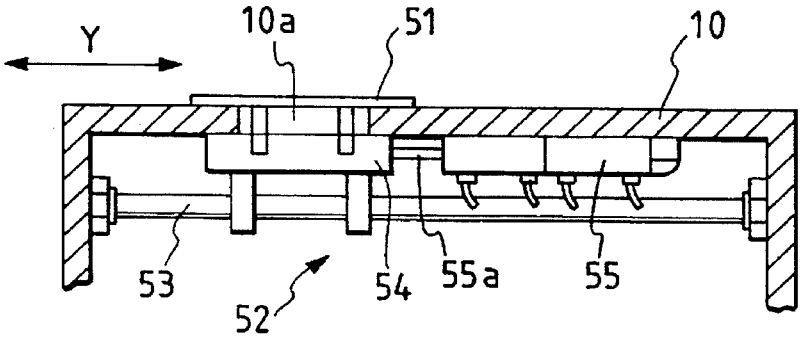
FIG. 18 is a fragmentary sectional view showing a holding-stand moving mechanism in the welt forming device shown in FIG. 17.
Figure 19:
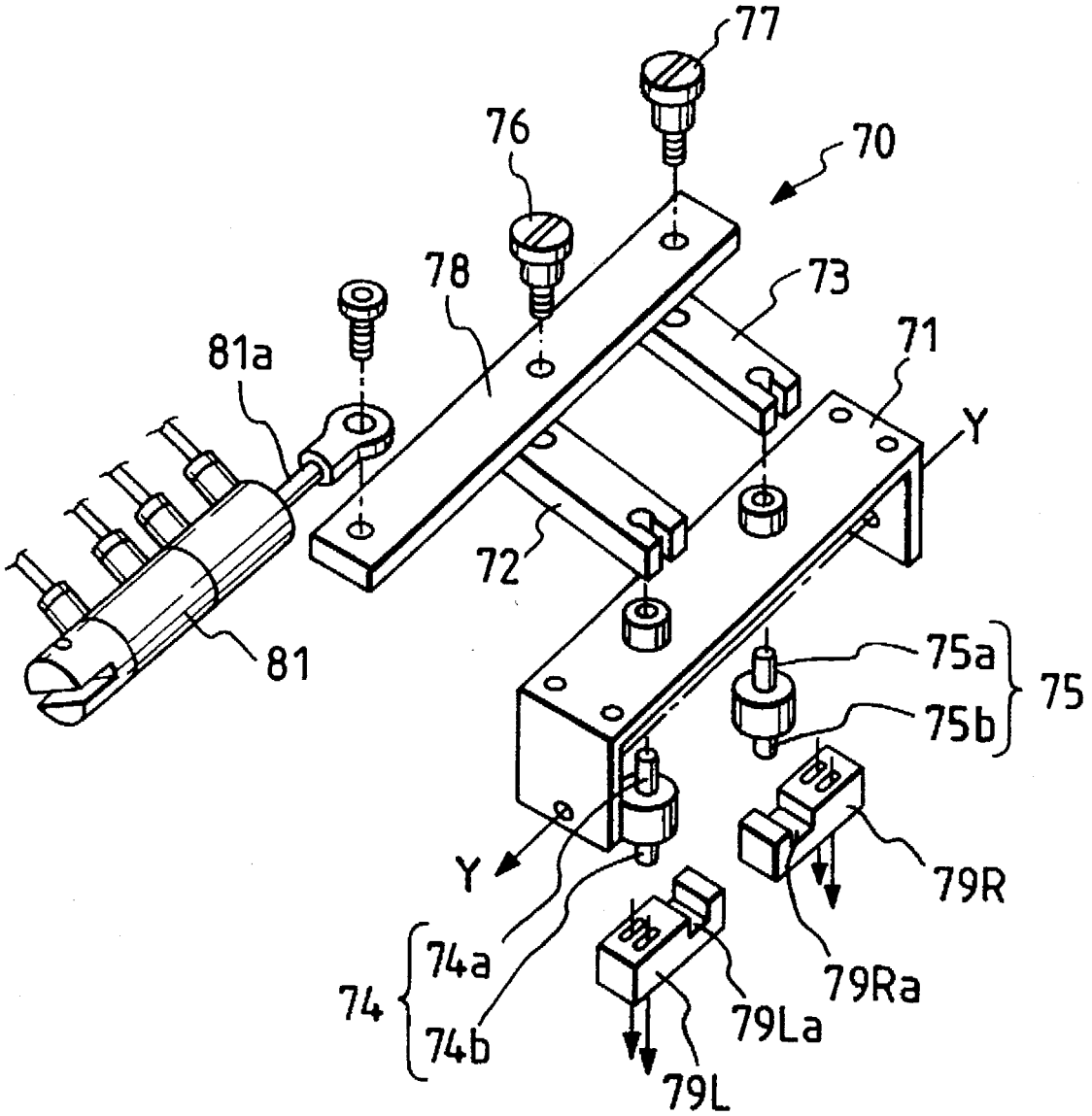
FIG. 19 is an exploded perspective view of an auxiliary retainer moving mechanism in the welt forming device shown in FIG. 17.

The fourth embodiment of the invention will be described with reference to FIGS. 17 through 19, in which parts corresponding functionally to those which have been described with reference to the first through fourth embodiments are therefore designated by the same reference numerals or characters. In FIGS. 17 through 19, reference character A3 designates the body of a two-needle type sewing machine (hereinafter referred to as "a sewing machine body", when applicable). The sewing machine body A3 is equal in seam-forming function to the one in the above-described third embodiment; however, the former is different from the latter in that it is not movable with respect to the sewing machine table 10. Reference character F2 designates a fabric guide which, similarly as in the case of the second embodiment, is made up of a folding part 39 and a holding part 40. Lifting mechanisms (not shown) for moving the folding part 39 and the holding part 40 are the same as those shown in FIG. 1.

Reference numeral 51 designates a base fabric holding stand. The base fabric holding stand 51 is engaged with a groove 10*a* as shown in FIG. 18 formed in the sewing machine table 10 in such a manner that it is movable in a transverse direction (or in the directions of the arrow Y). An opening (or a slot) 51*a* is formed in the sewing machine table 10 which exposes a needle board NB. The width of the opening 51*a* is larger than that of the needle board NB as viewed in the transverse direction.

A holding-stand moving mechanism 52 is adapted to move the base-fabric holding stand 51. The mechanism 52 comprises: a movable stand 54 which is mounted on a guide shaft 53 in such a manner that it is movable right and left; and an air cylinder 55 to drive the movable stand 54. The base-fabric holding stand 51 is secured to the movable stand 54. The air cylinder 55 is so designed that its cylinder rod 55*a* is protruded to take three positions in the transverse direction.

A pair of base fabric retainers 64L and 64R push the base fabric W1 on the base-fabric holding stand 51 from above. The base fabric retainers 64R and 64L are fixedly secured to ends of a pair of arms 65R and 65L, respectively, which are supported on a shaft 61. The base fabric retainers 64R and 64L together with the arms 65R and 65L are swingable about the shaft 61, and are linearly movable back and forth along the shaft 61 (in the transverse direction). Similarly as in the cases of the above-described embodiments, the base fabric retainers 64R and 64L are substantially axially symmetrical in configuration. The base fabric retainers 64R and 64L form base-fabric holding means C2. The base fabric retainers 64R and 64L accommodate second welt fabric holding means, namely, folding plates (not shown), respectively, which are caused to protrude and retract.

The arms 65R and 65L are moved right and left by an auxiliary retainer moving mechanism 70 as shown in FIG. 19.

In FIG. 19, a supporting stand 71 is secured to the above-described shaft 61. First ends of two swing arms 72 and 73, which are equal in length to each other, are swingably connected to the supporting stand 71 with two eccentric shafts 74 and 75. The remaining ends of the swing arms 72 and 73 are coupled to one linkage 78 with pivot screws 76 and 77. The linkage 78, the pair of swing arms 72 and 73, the supporting stand 71, and the pivot screws 76 and 77 and the eccentric shafts 74 and 75 through which those parts 78, 72, 73 and 71 are coupled to one another, form a quadric link mechanism. The eccentric shaft 74 includes an upper shaft 74*a* and a lower shaft 74*b* which are shifted from each other, and the eccentric shaft 75 also includes an upper shaft 75*a* and a lower shaft 75*b* which are shifted from each other. The upper shaft 74*a* and 75*a* are fixedly secured to the swing arms 72 and 73, respectively. The lower shafts 74*b* and 75*b* are movable engaged with grooves 79L*a* and 79R*a* formed in cams 79L and 79R which are secured to the parts a and b of the above-described arms 65L an 65R, respectively. The grooves 79L*a* and 79R*a* of the cams 79L and 79R are extended in a front-to-rear direction.

In FIG. 19, an air cylinder 81 is pivotally coupled to the sewing machine table 10. The cylinder rod 81*a* of the air cylinder is protruded to take three positions. The cylinder rod 81*a* is pivotally coupled to the linkage 78, so that the linkage 78 is moved parallel as the cylinder rod 81*a* is moved.

The auxiliary retainer moving mechanism 70 thus organized together with the arms 65R and 65L and the base fabric retainers 64R and 64L can be moved back and forth, as a whole, by a conventional main retainer moving mechanism. The retainer moving mechanism 70 and the holding-stand moving mechanism 52 form auxiliary moving means B2.

In the fourth embodiment designed in the above-described manner, as the cylinder rod of the air cylinder is operated, the pair of base fabric retainers 64R and 64L are parallel moved the same distance in the transverse direction.

When the linkage is moved in the transverse direction by operating the cylinder rod of the air cylinder, the swing arms 72 and 73 together with the upper shaft 74*a* and 75*a* are turned about the upper shafts 74*a* and 75*a* of the eccentric cylinders 74 and 75. Accordingly, the lower shafts 74*b* and 75*b* of the eccentric shafts 74 and 75 are swung about the upper shafts 74*a* and 75*a*, respectively. The transverse components of the swing motions of the lower shafts are transmitted through the cams 79L and 79R to the arms 65L and 65R, so that the arms 65L and 65R and the base fabric retainers 64L and 64R make parallel displacement along the supporting shaft 61 laid in the transverse direction.

The lower shafts 74*b* and 75*b* of the eccentric shafts 74 and 75 are equal in the amount of eccentricity and in phase to each other. Therefore, the base fabric retainers 64L and 64R are equal in the amount of displacement at all times; that is, the distance between the base fabric retainers 64L and 64R is maintained unchanged.

When the cylinder rod of the air cylinder is protruded to take three positions, the lower shafts 74*b* and 75*b* of the eccentric shafts 74 and 75 are also displaced to three positions in the transverse direction, and accordingly the base fabric retainers 64L and 64R are also shifted to three positions.

The positions to which the base fabric retainers 64L and 64R are moved by the air cylinder, can be suitably changed by combining the positions of the cylinder rod with the phase of the lower shafts 74*b* and 75*b*. In the embodiment, the phase of the lower shaft 74*b* and 75*b* is so determined that, as the cylinder rod is moved left to three positions, the base fabric retainers 64L and 64R are also moved left to three positions.

On the other hand, when the air cylinder 55 of the holding-stand moving mechanism 52 is operated, the air cylinder 81 of the auxiliary retainer moving mechanism 70 is operated. That is, when the cylinder rod 55*a* of the air cylinder 55 is protruded stepwise to the left, the cylinder rod 81*a* of the air cylinder 81 is protruded in three steps to the left, so that the base fabric holding stand 51 together with the base fabric retainers 64L and 64R is moved to the left.

The amount of movement of the base fabric holding stand 51 is accurately equal to the amount of movement of the base fabric retainers 64L and 64R. Hence, the base fabric holding stand 51 and the base fabric retainers 64L and 64R are moved as one unit in the transverse direction.

As is apparent from the above description, in the fourth embodiment, the base fabric W1 held between the base fabric holding stand 51 and the base fabric retainers 64L and 64R is moved to three positions in the transverse direction. That is, the positional relationship of the sewing needle N and the fabrics W to be sewed can be changed. Hence, similarly as in the case of the above-described second embodiment, the four seams can be formed by performing the sewing operation three times.

Figure 14A:
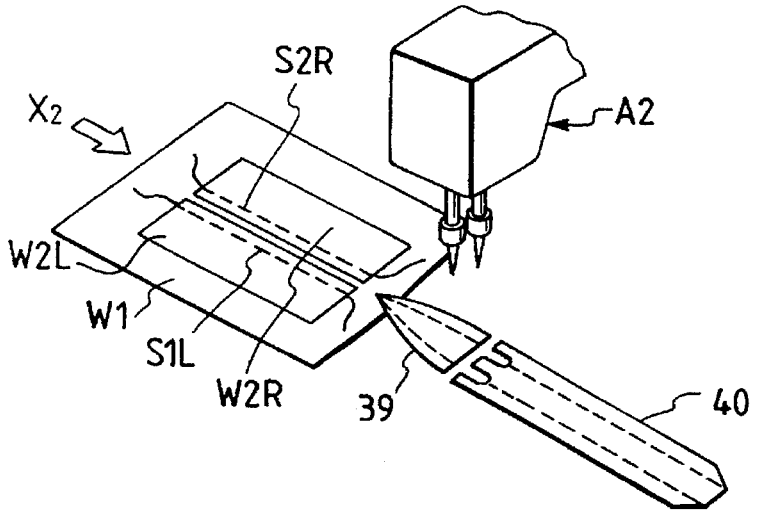
FIG. 14(*a*) is an explanatory perspective view showing a fabric guide which is lowered on the sewing machine table.
FIG. 14(c) is a sectional view of the welt fabrics, corresponding to FIG. 14(*b*), FIGS. 14(*a*) to 14(c) are for a description of the procedure of sewing seam with the welt forming device shown in FIGS. 12(*a*) and 12(*b*)
Figure 14B:
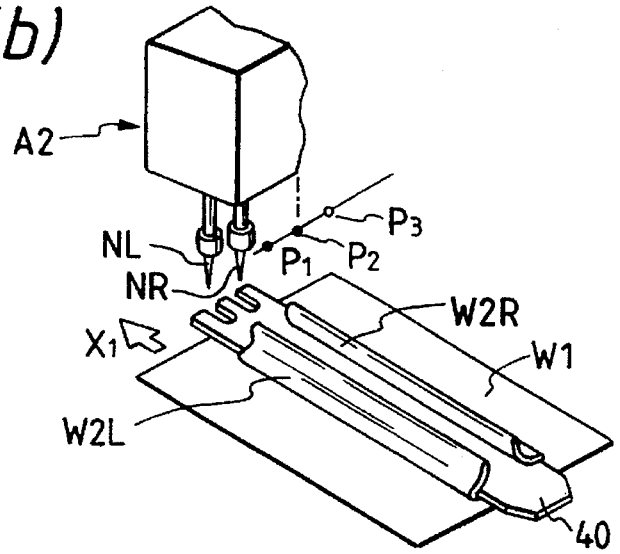
Figure 14C:
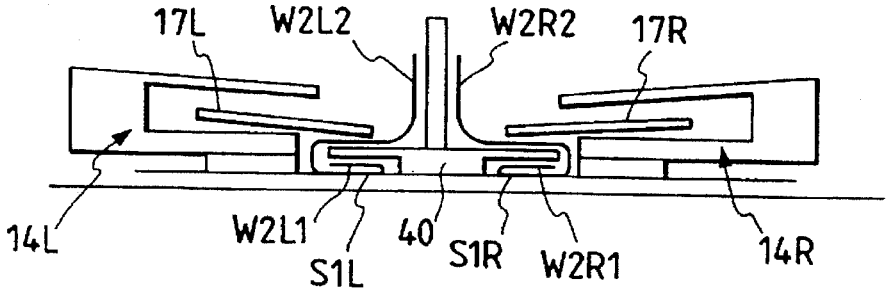

That is, in the first sewing operation, only one of the sewing needles is operated; that is, the sewing needle NL is operated to sew the left welt fabric W2L to the base fabric W1 as shown in FIG. 13(*a*); in the second sewing operation, the other sewing needle NR is operated to sew the right welt fabric W2R to the base fabric W1 as shown in FIG. 13(*b*); and in the third sewing operation, the pair of welt fabrics W2R and W2L each of which has been folded in three layers are sewed to the base fabric W1 with the two sewing needles N at the same time as shown in FIG. 14(*c*). Thus, similarly as in the case of the second embodiment, the aimed welts are obtained by forming the four seams S1L, S1R, S2L and S2R as shown in FIG. 11.

In this case, in order to sequentially change the positional relationship between the sewing needles N and the fabrics to be sewed as shown in FIGS. 13(*a*), 13(*b*) and 14(*c*), instead of the sewing machine body A1 the fabrics to be sewed are moved. This is a specific feature of the fourth embodiment which makes the latter different from the second embodiment.

In moving the base fabric W1, the base fabric holding stand 51 together with the base fabric retainers 64R and 64L is moved. Hence, the base fabric W1 is maintained stretched at all times, which makes it possible to form the seams at the predetermined positions.

Similarly as in the above-described embodiments, in forming the seams, the main moving means (not shown) moves the base fabric retainers 64R and 64L intermittently in the sewing direction in synchronization with the vertical movements of the sewing needles NR and NL thereby to slide the base fabric W1 on the upper surface of the base fabric holding stand 51. The welt fabrics W2R and W2L are folded in the same manner as those in the second embodiment.

Figure 20:
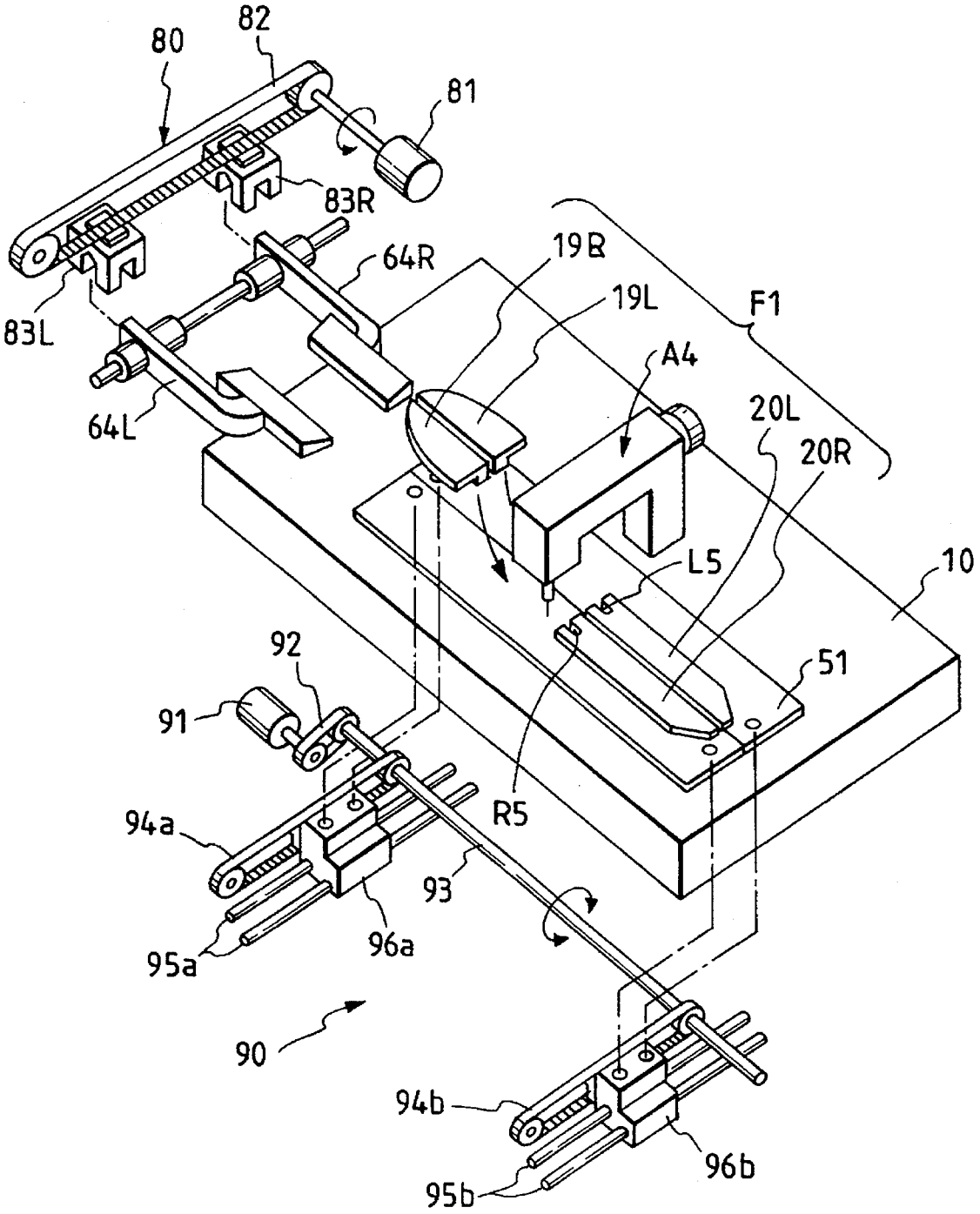
FIG. 20 is an explanatory perspective view showing another welt forming device, according to a fifth embodiment of the invention.
Figure 21A:
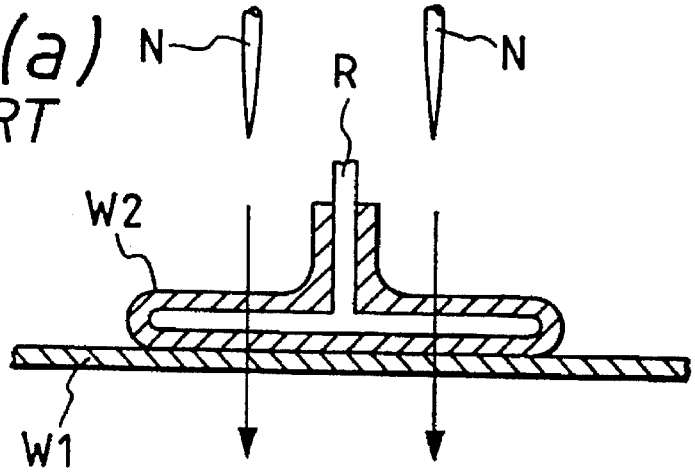
FIG. 21(a) PRIOR ART
FIGS. 21(*a*) to 21(*c*) are sectional views for a description of a procedure of forming an example of a conventional welt.
Figure 21B:
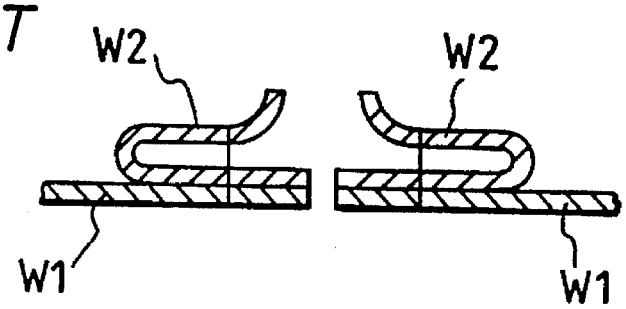
FIG. 21(b) PRIOR ART
Figure 21C:
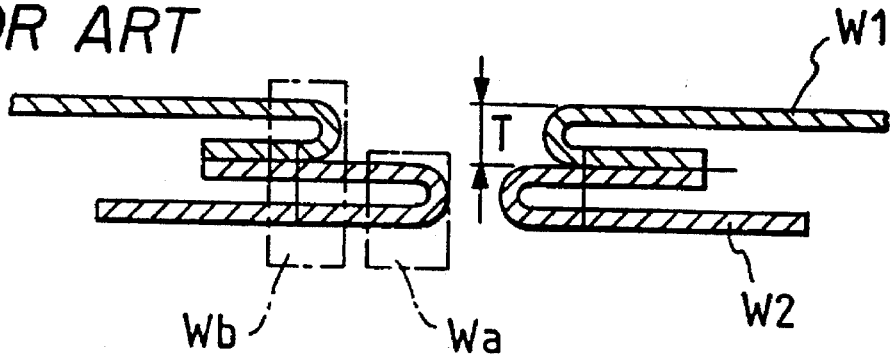
FIG. 21(c) PRIOR ART
Figure 22A:
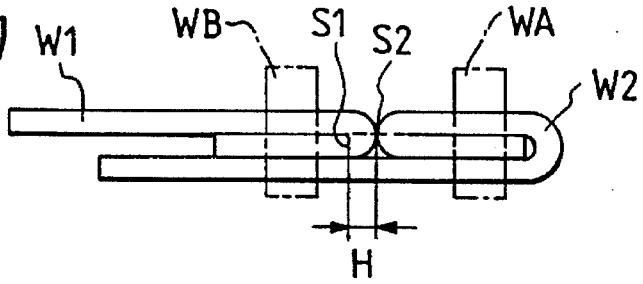
FIG. 22(a) PRIOR ART
FIG. 22(*a*) is an enlarged side view of another example of the conventional welt.
Figure 22B:
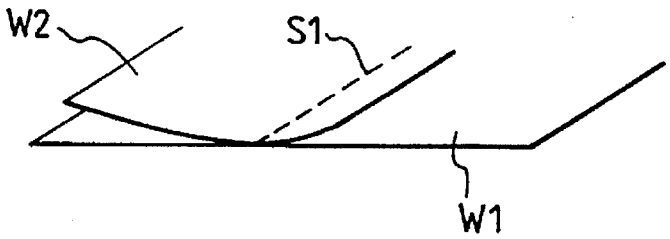
FIG. 22(b) PRIOR ART
Figure 22C:
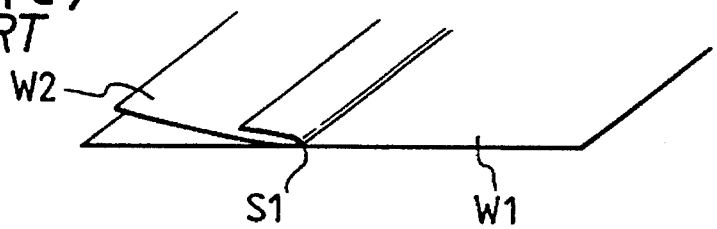
FIG. 22(c) PRIOR ART
Figure 22D:
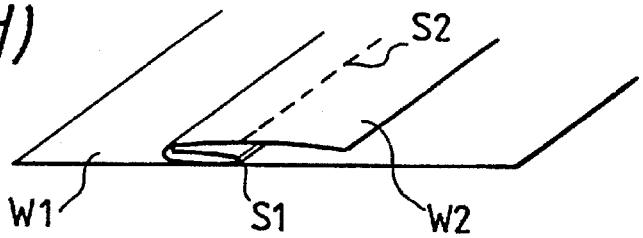
FIG. 22(d) PRIOR ART
Figure 22E:
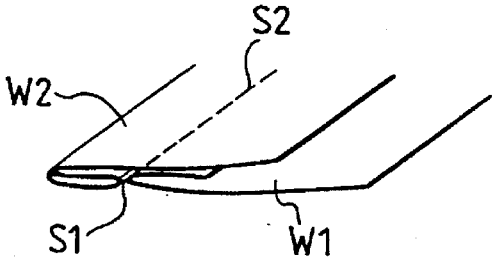
FIG. 22(e) PRIOR ART
Figure 23:
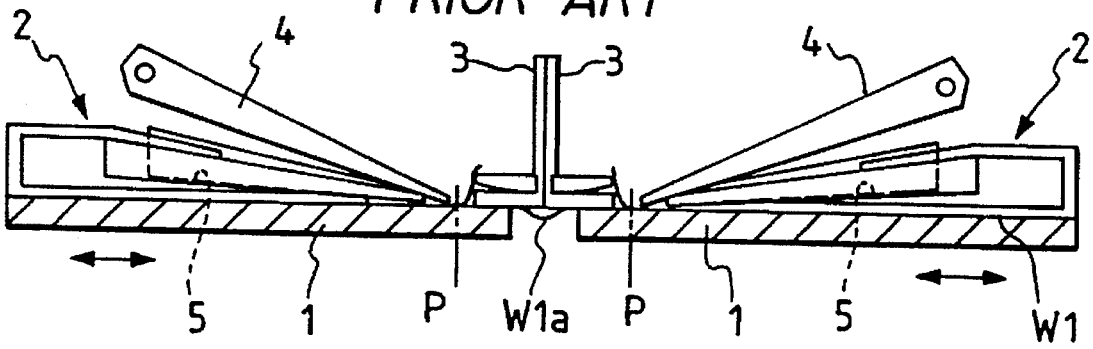
FIG. 23 PRIOR ART
FIG. 23 is a sectional front view showing a part of a conventional welt forming device which is used to form the welt shown in FIG. 22(*a*)
Figure 24:
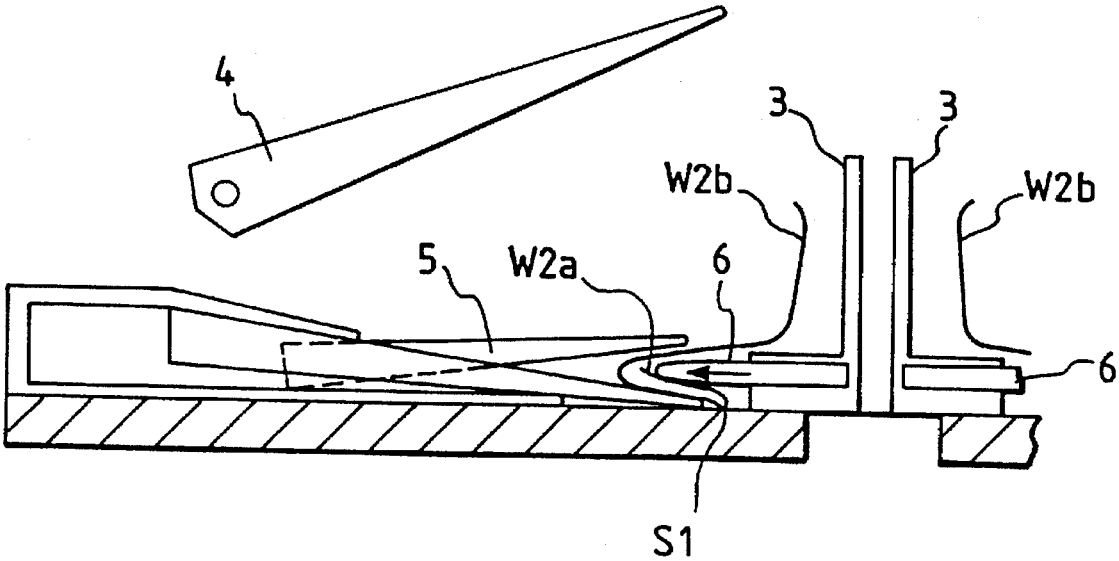
FIG. 24 PRIOR ART
FIG. 24 is a fragmentary sectional view showing a welt fabric folded on the conventional welt forming device.

A fifth embodiment of the invention will be described with reference to FIG. 20.

In the fifth embodiment, a single-needle type sewing machine is employed as a sewing machine body A4, and a fabric guide F1 is the same as the one in the first embodiment, and a pair of base fabric retainers 64R and 64L and a base fabric holding stand 51 are moved in a transverse direction by pulse motors. The base fabric retainers 64R and 64L and the base fabric holding stand 51 are the same as those in the above-described fourth embodiment.

In the fourth embodiment, an auxiliary retainer moving mechanism 80 adapted to move the base fabric retainers 64R and 64L in a transverse direction comprises: a pulse motor 81; an endless belt 82 driven by the pulse motor 81; and two movable stands 83R and 83L coupled to the endless belt 82. The endless belt 82 is locked through the movable stands 83R and 83L to predetermined parts of the base fabric retainers 64R and 64L.

An auxiliary holding-stand moving mechanism 90 adapted to move the base fabric holding stand 51 comprises: a pulse motor 91; a rotary shaft 93 coupled through an endless belt 92 to the pulse motor 91; endless belts 94*a* and 94*b* which are driven by the rotation of the rotary shaft 93; a pair of guide shafts 95*a* and 95*a* which are extended in the transverse direction; another pair of guide shaft 95*b* and 95*b*, and a movable stand 96*a* which is movably supported by the pair of guide shafts 95*a*; and another movable stand 96*b* which is movably supported by the pair of guide shaft 95*b*. The movable stands 96*a* and 96*b* are coupled to the front and rear ends of the base fabric holding stand 51, respectively. The auxiliary holding-stand moving mechanism 90 and the auxiliary retainer moving mechanism 80 form auxiliary moving means. The other arrangements are the same as those in the second embodiment.

In the fifth embodiment thus organized, the endless belt 82 is driven by the pulse motor 81 so that the base fabric retainers 64R and 64L are moved parallel while maintaining a certain distance between them. When the pulse motor 81 is operated, the pulse motor 91 is also operated, so that the rotary shaft 93 is rotated. The rotation of the rotary shaft 93 is transmitted through the endless belts 94*a* and 94*b* to the movable stands 96*a* and 96*b*, so that the latter 96*a* and 96*b* are moved the same distance. Thus, the base fabric retainers 64L and 64R and the base fabric holding stand 51 are moved parallel in the transverse direction. The amount of movement of the base fabric holding stand 51 is equal to the amount of movement of the base fabric retainers 64R and 64L. Hence, the base fabric retainers 64R and 64L and the base fabric holding stand 51 are moved as one unit in the same direction. Hence, the base fabric W1 held flat between the base fabric holding stand 51 and the base fabric retainers 64R and 64L can be moved in the transverse direction. Therefore, the four seams can be formed at the predetermined positions with high accuracy.

In the fifth embodiment, the single-needle type sewing machine is employed. Hence, the forward and backward movement of the base fabric retainers 64L and 64R, and the movement of the fabric guide F2 are performed in the same manner as in the above-described first embodiment, and the aimed welts are formed by repeating the sewing operation four times while the pair of folding parts 19L and 19R and the pair of holding parts 20L and 20R are being operated independently of one another. Accordingly, the fifth embodiment is lower in productivity than the above-described fourth embodiment. However, the fifth embodiment has a wide range of application. That is, it can form welts different in size merely by changing the positions of the base fabric retainers 64L and 64R and the welt fabric holding stand with the pulse motors 81 and 91.

The fifth embodiment may be so modified that a two-needle type sewing machine having a one-needle stopping mechanism is employed as a sewing machine body. The fifth embodiment thus modified has the productivity of the fourth embodiment in addition to the wide range of application.

In the first through fifth embodiments, the folding parts 19L and 19R of the fabric guide are separated from the holding parts 20L and 20R. The folding parts 19L and 19R may be arranged at the rear of the holding parts 20L and 20R depending on the direction of movement of the base fabric W1 and the welt fabrics W2L and W2R which are being folded. That is, if the device is so designed that the welt fabrics W2L and W2R are folded after the base fabric W1 and the welt fabrics W2L and W2R are moved forwardly, then the folding parts 19L and 19R may be arranged at the rear of the holding parts 20L and 20R. In this case, the folding parts 19L and 19R and the holding parts 20L and 20R may be formed as one unit. That is, while the preferred embodiments of the invention have been described, it should be noted that the invention is not limited thereto or thereby.

The technical concept of the invention is applicable to the formation of a single welt as well as a pair of welts.

As was described above, in the welt forming device in which the operation of forming the first and second seams in parallel with each other and the operation of folding the welt fabric are carried out to form a welt in such a manner that, in the welt, the sewed part is equal in the number of fabric layers to the exposed part, and the surface of the base fabric is flush with the surface of the welt fabric; the base fabric is held flat by the base fabric holding means at all times, and the relative position of the base fabric holding means and the sewing needle is moved by the auxiliary moving means in the predetermined direction which is across the sewing direction. Hence, the first and second seams can be formed accurately at the aimed positions irrespective of the kind or material of the fabric, and the resultant welt is therefore excellent in quality.

The fabric guide made up of the rise portion which is extended upwardly and the flat portion, has the following effect or merit: With the fabric guide, a fabric is moved backwardly while the end of one side portion of the fabric is being abutted against the fabric guide, so that the one side portion is gradually folded over the upper surface of the fabric beginning with the front end thereof. Hence, in a device having a fabric conveying function such as the above-described welt forming device, the fabric can be folded without use of a special actuator. That is, with the fabric guide of the invention, a fabric folding function can be realized at low cost.

What is claimed is:

1. A welt forming device for sewing together a base fabric and a welt fabric, said welt forming device comprising:

seam forming means, including a sewing needle, a seam forming mechanism and a sewing machine table, for forming a seam on the base and welt fabrics laid over said sewing machine table, said seam forming mechanism moving said sewing needle up and down;

base fabric holding means for holding the base fabric flat on said sewing machine table at all times and moving the base fabric in a sewing direction;

welt fabric holding means for fixedly holding the welt fabric on the base fabric in order to move together the welt fabric with the base fabric;

main moving means for moving said base fabric holding means and said welt fabric holding means in the sewing direction, said main moving means being moved in synchronization with said seam forming means wherein a first seam is formed to sew the base fabric and the welt fabric together;

first welt fabric folding means for folding one side portion of the welt fabric along said first seam over the other side portion thereof;

second welt fabric folding means for folding the other side portion of the welt fabric over the one side portion of the welt fabric folded by said first welt fabric holding means; and auxiliary moving means for moving the relative positions of said base fabric holding means and said sewing needle in a predetermined direction across the sewing direction, said auxiliary moving means moving said welt fabric folded by said first and second welt fabric folding means and said base fabric to which said welt fabric is sewed in the predetermined direction, wherein said seam forming means is operated in synchronization with said main moving means, wherein a second seam is formed in parallel with said first seam to sew the other side portion of the welt fabric to the base fabric.

2. A welt forming device according to claim 1, wherein said auxiliary moving means horizontally moves said sewing needle with respect to said base fabric holding means in the predetermined direction, and wherein, after said sewing needle is horizontally moved by said auxiliary moving means in the predetermined direction with respect to the welt fabric folded by said first and second welt fabric folding means and the base fabric to which the welt fabric is sewed, said seam forming means is operated in synchronization with said main moving means.

3. A welt forming device according to claim 1, wherein said auxiliary moving means horizontally moves said base fabric holding means in the predetermined direction, and wherein, after the welt fabric folded by said first and second welt fabric folding means and the base fabric to which the welt fabric is sewed are moved parallel by said auxiliary moving means, said seam forming means is operated in synchronization with said main moving means for forming said second seam near and along said first seam to sew the other side portion of the welt fabric to the base fabric.

4. A welt forming device according to claim 1, wherein said seam forming means includes two sewing needles, and wherein said auxiliary moving means allows said base fabric holding means and said sewing needles to take three relative positions in each welt forming operation.

5. A welt forming device according to claim 1, wherein said first welt fabric folding means includes:

a bottom portion;

a rise portion upwardly extending from one end of said bottom portion, said rise portion provided in a direction across the sewing direction in part serving as a folding part and provided in parallel with the sewing direction in part serving as a holding part; and a flat portion horizontally extending from one end of said rise portion, wherein said welt fabric is moved in the sewing direction while one end portion of the welt fabric is abutted against said rise portion for gradually folding the one end portion of the welt fabric over the upper surface of the welt fabric beginning with the front edge of the welt fabric, and then leading the front edge of the welt fabric into said holding part to maintain the welt fabric folded.

6. A welt forming device according to claim 5 wherein said folding part and said holding part are separated from each other.

7. A welt forming device according to claim 6 wherein said folding part includes a right folding part and a left folding part which are symmetric, and wherein said holding part includes a right holding part and a left holding part which are symmetric.

8. A welt forming device according to claim 6 wherein said holding part has a groove for receiving said sewing needle.

9. A welt forming device according to claim 5 wherein said folding part is positioned upstream with respect to said holding part in the sewing direction.

10. A fabric guide for a sewing machine comprising:

a bottom portion;

a rise portion upwardly extending from one end of said bottom portion, said rise portion provided in a direction across a sewing direction in part serving as a folding part and provided in parallel with the sewing direction in part serving as a holding part wherein said folding part, and said holding part are separated from each other; and a flat portion horizontally extending from one end of said rise portion, wherein said welt fabric is moved in the sewing direction while one end portion of a work is abutted against said rise portion for folding the one end portion of the work over the upper surface of the work beginning with the front edge of the work, and then leading the front edge of the work into said holding part to maintain the work folded.

11. A fabric guide according to claim 10 wherein said folding part includes a right folding part and a left folding part which are symmetric, and wherein said holding part includes a right holding part and a left holding part which are symmetric.

12. A fabric guide according to claim 10 wherein said holding part has a groove for receiving said sewing needle.

13. A fabric guide according to claim 10 wherein said folding part is positioned upstream with respect to said holding part in the sewing direction.

14. A method for controlling a welt forming apparatus, said welt forming apparatus comprising a pair of needles and a sewing head, said method comprising the steps of:

(a) stitching one of a pair of welt fabrics arranged on a base fabric by one of said pair of needles;

(b) moving said sewing head to a predetermined distance in direction of the other of said pair of needles;

(c) stitching the other of said pair of welt fabric on said base fabric by said other needle, said other welt fabric arranged separately in parallel with said one welt fabric;

(d) folding said pair of welt fabrics such that inner portions of said pair of welt fabrics confronting with each other along stitching lines formed by said steps (a) and (c) are outwardly folded, and that outer portions of said pair of welt fabrics are inwardly folded over said inner portions of said pair of welt fabrics outwardly folded;

(e) stitching said outer portions of said pair of welt fabrics inwardly folded by said pair of needles inner than the stitching lines formed by said steps (a) and (c), each of said needles positioned near each of the stitching lines formed by said steps (a) and (c); and (f) cutting said base fabric between stitching lines formed by said step (e).

15. A method according to claim 14, further comprises:

(g) moving said one needle from an initial position to a predetermined position with respect to said one welt fabric arranged on said base fabric, before said step (a).

16. A method according to claim 15, wherein said welt forming device further comprises a fabric guide, and wherein, in said step (d), said pair of welt fabrics are moved such that said fabric guide passes along the stitching lines formed by said steps (a) and (c).

* * * * *

UNITED STATES PATENT AND TRADEMARK OFFICE

CERTIFICATE OF CORRECTION

PATENT NO. : 5,640,917

DATED : June 24, 1997

INVENTOR(S) : Tomio NII et al.

It is certified that error appears in the above-indentified patent and that said Letters Patent is hereby corrected as shown below:

Col. 19, line 55, change "part," -- part--.

Signed and Sealed this

Twenty-seventh Day of October, 1998

*Attest:*

Bruce Lehman

BRUCE LEHMAN

*Attesting Officer*

*Commissioner of Patents and Trademarks*